US008544985B2

(12) United States Patent
Heo et al.

(10) Patent No.: US 8,544,985 B2
(45) Date of Patent: Oct. 1, 2013

(54) PRINT HEAD MAINTENANCE APPARATUS AND IMAGE FORMING APPARATUS HAVING THE SAME

(75) Inventors: Gun Heo, Suwon-si (KR); Youn-gun Jung, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 444 days.

(21) Appl. No.: 12/791,948

(22) Filed: Jun. 2, 2010

(65) Prior Publication Data

US 2011/0057990 A1 Mar. 10, 2011

(30) Foreign Application Priority Data

Sep. 4, 2009 (KR) ..... 10-2009-0083604

(51) Int. Cl.
*B41J 2/165* (2006.01)

(52) U.S. Cl.
USPC ..... 347/33; 347/22; 347/34; 347/32

(58) Field of Classification Search
USPC ..... 347/33, 22, 34, 32
See application file for complete search history.

(56) References Cited

U.S. PATENT DOCUMENTS

| | | | | |
|---|---|---|---|---|
| 5,467,114 | A * | 11/1995 | Ebinuma et al. | 347/32 |
| 6,151,044 | A * | 11/2000 | Gaasch | 347/33 |
| 6,497,471 | B1 * | 12/2002 | Gargir | 347/28 |
| 7,568,782 | B2 | 8/2009 | Kachi et al. | |
| 2009/0267987 | A1 * | 10/2009 | Kachi et al. | 347/33 |

FOREIGN PATENT DOCUMENTS

| | | |
|---|---|---|
| JP | 09-048134 | 2/1997 |
| JP | 2008132786 | 6/2008 |
| KR | 1020070021457 | 2/2007 |

* cited by examiner

*Primary Examiner* — Henok Legesse
(74) *Attorney, Agent, or Firm* — Stanzione & Kim, LLP

(57) ABSTRACT

An image-forming apparatus includes a print head unit including a plurality of head chips disposed in a widthwise direction of a supplied printing medium to eject ink to form an image, a wiping unit including a plurality of wiper members disposed in the widthwise direction of the printing medium, and a support member supporting the plurality of wiper members and located below the print head unit to move upwardly and downwardly. The image-forming apparatus also includes an ink discharging unit which accommodates and discharges ink spitted from the print head unit, an elevating driving unit which moves the wiping unit upwardly and downwardly between at least two positions of a first forward position which is a wiping standby position, a second forward position which is a scrapping position, and a retracted position, and a widthwise direction driving unit which reciprocates the wiping unit positioned in the first or second forward positions by the elevating driving unit.

9 Claims, 22 Drawing Sheets

PRINT HEAD MAINTENANCE APPARATUS AND IMAGE FORMING APPARATUS HAVING THE SAME

CROSS-REFERENCE TO RELATED APPLICATIONS

This application claims priority under 35 U.S.C. §119 to Korean Patent Application No. 10-2009-0083604, filed on Sep. 4, 2009 in the Korean Intellectual Property Office, the disclosure of which is incorporated herein by reference in its entirety.

BACKGROUND

1. Field of the Invention

An apparatus consistent with the present general inventive concept relates to an image forming apparatus, and more particularly, to an image forming apparatus having a maintenance configuration capable of maintaining an optimum ink ejecting performance of a print head.

2. Description of the Related Art

An image forming apparatus such as a printer, an electronic copier, a facsimile, a multifunction device, etc. may be classified depending on a printing type into an inkjet type that ejects ink through a nozzle, a thermal transfer type that uses a thermal head, or an electrophotographic type that forms an image through processes of charging, exposing, developing, transferring, and fusing.

An image forming apparatus of the inkjet type includes a print head having a nozzle. The nozzle is located on an ink ejecting surface of the print head and may be blocked by a foreign substance or may be polluted by an ink of other colors. Also, a meniscus in an end part of the nozzle formed by an ink tension may be broken.

Accordingly, the image forming apparatus of the inkjet type needs a maintenance apparatus to maintain the nozzle and the print head to be an optimum state. The maintenance apparatus may include modules, units, or configurations to perform a wiping function, a capping function to protect the print head, a spitting function to remove a foreign material in the nozzle, a scrapping function to clean a wiper a wiper, etc. The wiping configuration may be used to clean a surface of a print head to remove excess ink and a foreign material of an end part of the nozzle.

A conventional image forming apparatus employs an inkjet print head of an array type extending along a widthwise direction of a printing medium to be capable of printing a single line at once and a wiping configuration to clean the print head. The wiping configuration may include a single blade type wiper, a lengthwise direction of which is disposed in a widthwise direction of a printing medium. The wiper concurrently performs a wiping operation with respect to a plurality of print heads while moving in a parallel direction with a proceeding direction of a printing medium. After the wiping, the nozzle may be controlled to spit any excess partially ejected or excess ink into a spittoon that has a widthwise length of the wiper in a side of the wiper. Scrapped ink collected through the spittoon is ejected through an ink ejecting hole formed in a middle part of the spittoon. Also, scrapped ink that is adhered to an end part of the wiper during the wiping may be removed by using a scrapper.

In the image forming apparatus employing the wiper having the above configuration, the wiping efficiency may be poor because it may be necessary to use a wiper blade having a wide width, and it may be difficult to perform the wiping with respect to each of the plurality of print heads with the uniform force.

Also, if the wiper blade is formed of a rubber material, and since rubber may absorb ink, the volume of the rubber expands as ink is absorbed. Accordingly, an end of the wiper may be deformed into a wave pattern shape, which may negatively impact the wiping performance.

Also, during the scrapping operation, scrapped ink that has been transferred to the scrapper may be inversely transferred to the wiper blade, thereby causing a mixed color in printing or a nozzle blockage.

SUMMARY

Accordingly, it is an aspect of the present general inventive concept to improve maintenance performance by providing an image forming apparatus to prevent a wiping performance deterioration due to a wiper deformation and concurrently to perform total maintenance processes by using a space provided in a lower part of a print head of an array type to reduce the size of a product.

Additional aspects and utilities of the present general inventive concept will be set forth in part in the description which follows and, in part, will be obvious from the description, or may be learned by practice of the general inventive concept.

Features and/or utilities of the present general inventive concept can be achieved by providing an image forming apparatus, including a print head unit which includes a plurality of head chips disposed in a widthwise direction of a supplied printing medium, and ejects an ink to form an image, a wiping unit which includes a plurality of wiper members disposed in the widthwise direction of the printing medium and a support member supporting the plurality of wiper members, and is disposed to a lower part of the print head unit to move upwardly and downwardly, an ink discharging unit which accommodates and discharges an ink spitted from the print head unit, an elevating driving unit which moves the wiping unit upwardly and downwardly between at least two positions of a first forward position which is a wiping standby position, a second forward position which is a scrapping position, and a retracted position which retreats to obtain a capping space, and a widthwise direction driving unit which reciprocates the wiping unit positioned in the first or second forward positions by the elevating driving unit in an arrangement direction of the print head unit.

The wiping unit further may include a wiper frame which supports the support member and a guide unit which is provided to respectively correspond to the wiper frame and the support member to guide an elevating of each wiper member when the support member moves in the widthwise direction of the printing medium by the widthwise direction driving unit.

The guide unit may guide the wiping unit so that the plurality of wiper members can move upwardly to a position to contact an ink ejecting surface of the print head unit from the first forward position when the support member moves in a first direction by the widthwise direction driving unit and so that the plurality of wiper members can maintain the first forward position when the support member moves in the opposite direction to the first direction.

The guide unit may include a guide protrusion which is formed to one of the wiper frames and the support member and a guide groove which is formed to the other of the wiper frames and the support member to guide an elevating of the guide protrusion.

The scrapped ink discharging unit may include a spittoon which is provided in the support member and guides an ink spitted from the print head unit to an ink accommodating unit, the ink accommodating unit which is provided to a lower part of the spittoon and accommodates an ink discharged from the spittoon, a scrapped ink storing unit which accommodates an ink discharged through an ink discharging hole formed to the ink accommodating unit, and a discharging driving source which is provided on an ink discharging path between the ink accommodating unit and the scrapped ink storing unit and moves an ink in the ink accommodating unit to the scrapped ink storing unit.

The ink accommodating unit may include a plurality of accommodating spaces respectively provided to a position corresponding to at least one head chip of the plurality of head chips, and the scrapped ink discharging hole may be formed to each of the plurality of accommodating spaces so that a scrapped ink respectively accommodated in the plurality of accommodating spaces can be concurrently discharged to the scrapped ink storing unit.

The widthwise direction driving unit may include a shuttle including a first engagement unit and disposed to move in the widthwise direction of the printing medium, and a shuttle driving source driving the shuttle, and the wiping unit may further include a second engagement unit formed to the support member and engaged with the first engagement unit when the wiping unit is positioned in the first and second forward positions.

The image forming apparatus may further include a stopper which located on at least one of the wiping unit and the print head unit to maintain a contacting force between the head chip and the wiper when the plurality of wiper members contact to the ink ejecting surface to perform a wiping operation.

The image forming apparatus may further include a platen positioned below the print head unit to move between a first standby position and a printing medium support position supporting a printing medium so that the printing medium can contact a head chip surface of the print head unit in a printing operation, and a platen driving unit to drive the platen so that the platen can move between the first standby position and the printing medium support position.

The image forming apparatus may further include a scrapping unit which positioned below the print head unit to move between a second standby position and a cleaning position to clean the plurality of wiper members, and a scrapping driving unit to drive the scrapping unit so that the scrapping unit can move between the cleaning position and the second standby position.

The image forming apparatus may further include a capping unit positioned below the print head unit to move between a third standby position and a capping position capping the head chip surface of the print head unit.

Features and/or utilities of the present general inventive concept may also be realized by a print head maintenance apparatus including a wiping unit including at least one wiper blade to wipe at least one head chip of a print head, a scrapping unit to scrap ink from the at least one wiper blade of the wiping unit, and a platen to support a recording medium when the at least one head chip is emitting ink onto the recording medium. Each of the wiping unit, the scrapping unit, and the platen may be able to be positioned in a first retracted position spaced from and facing a surface of the at least one head chip and a second position adjacent to the print head unit, respectively, and the wiping unit may be able to be positioned in a third scrapping position located between the first position and the second position when the scrapping unit is located in the second position, such that a bottom surface of the scrapping unit contacts the at least one wiper blade of the wiping unit.

Features and/or utilities of the present general inventive concept may also be realized by a print head maintenance apparatus including a wiping unit including at least one wiper to wipe a corresponding at least one head chip of a print head and a scrapping unit to scrap ink from the at least one wiper of the wiping unit. The scrapping unit may include a capping member on a first side facing the print head unit to cap the at least one head chip when the scrapping unit is in a scrapping position.

The scrapping unit may include a belt having an exposed portion on a second side of the scrapping unit opposite the first side to face the at least one wiper blade of the wiping unit and a belt storage to store a non-exposed portion of the belt.

The exposed portion of the belt may have a first length and a non-exposed portion of the belt may have a second length greater than the first length.

A ratio of a non-exposed belt length to an exposed belt length is at least 2:1.

Features and/or utilities of the present general inventive concept may also be realized by a print head maintenance apparatus including a wiping unit including at least one wiper to wipe at least one head chip of a print head, the wiping unit to receive a force from a first direction parallel to a surface of the head chip that emits ink and to move the wiping unit in at least a second direction towards the print head in response to the force from the first direction.

The print head maintenance apparatus may further include a driving unit to move the wiping unit in the second direction to a wiping standby position before the wiping unit support member receives the force from the first direction.

The print head maintenance apparatus may further include a driving unit to apply the force from the first direction to the wiping unit support member.

The wiping unit may include a wiping unit support member to hold the at least one wiper and a wiping unit frame to receive the wiping unit support member.

One of the wiping unit support member and the wiping unit frame may include a guide protrusion and the other of the wiping unit support member and the wiping unit frame may include a guide groove, the guide groove including an inclined portion, such that when the force is applied to the wiping unit from the first direction, the guide protrusion is directed up the inclined portion of the guide groove to put the at least one wiper in a wiping position to wipe the surface of the head chip.

The guide groove may include an upper portion located above a first guide groove protrusion and a lower portion located below the first guide groove protrusion, a first level change area including the inclined portion to guide the guide protrusion from an elevation level corresponding to the lower portion to an elevation corresponding to the upper portion, and a second level change area to guide the guide protrusion from the elevation level corresponding to the upper portion to the elevation corresponding to the lower portion. When the guide protrusion is located at a first position at a base of the inclined portion and receives the force in the first direction, the guide protrusion is guided up the inclined portion of the first level change area to a second position at a first end of the upper portion of the guide groove, when the guide protrusion is located at the second position and receives the force in the first direction, the guide groove moves along the first direction from the second position to the second level change area and down to a third position adjacent to the second level change area at the lower portion of the guide groove, and when the guide protrusion is located at the third position and receives a force in a third direction opposite the first direction, the guide protrusion moves along the lower portion in the third direction to the first position.

A lower edge of the lower portion of the guide groove may include a recess corresponding to a fourth position between the third position and the first position to hold the guide groove in the fourth position.

The second direction may be perpendicular to the first direction and a third direction is perpendicular to each of the first direction and the second direction, and the lower portion of the guide groove may include a second inclined portion between the third position and the first position, the second inclined portion inclined in the third direction so as to decrease a depth of the guide groove between the third position and the first position.

At least one wiper may have a width in the first direction greater than a width in the first direction of the head chip.

The at least one wiper may include a plurality of wipers positioned to correspond to a respective plurality of head chips, such that each wiper is positioned to wipe a surface of at least one head chip different from that of each other wiper. The at least one wiper may be detachably mounted to the wiping unit.

The wiping unit may further may include at least one spittoon positioned beneath the at least one wiper to receive ink emitted toward the at least one wiper.

The wiping unit further may include at least one ink accommodating recess beneath the at least one spittoon, to accommodate ink received by the spittoon, the ink accommodating recess including a hole in a bottom portion of the recess to emit ink accommodated by the recess.

The print head maintenance apparatus may further include an ink storage unit to store ink emitted by the hole in the bottom of the ink accommodating recess.

The print head maintenance apparatus may further include a discharge driving source to drive ink emitted by the hole in the bottom of the ink accommodating recess to the ink storage unit.

The at least one wiper may include a plurality of wipers, the at least one spittoon may include a plurality of spittoons, each corresponding to at least one wiper, respectively, and the at least one ink accommodating unit may include a plurality of ink accommodating units, each to receive ink from at least one of the plurality of spittoons, respectively.

The print head maintenance apparatus may further include a scrapping unit to scrap ink from the at least one wiper of the wiping unit.

The scrapping unit may include a belt having an exposed portion to face the at least one wiper to scrap ink from the wiper and a belt storage unit to store a non-exposed portion of the belt.

The scrapping unit may include a capping member on an upper surface facing the head chip of the print head, such that when the scrapping unit is in a scrapping position above the wiping unit, the capping member caps the at least one head chip to prevent the at least one head chip from emitting ink.

Features and/or utilities of the present general inventive concept may also be realized by a print head maintenance system including a print head including at least one head chip to emit ink onto a recording medium, a wiping unit including at least one wiper blade to wipe the at least one head chip of the print head, a scrapping unit to scrap ink from the at least one wiper blade of the wiping unit, and a platen to support a recording medium when the at least one head chip is emitting ink onto the recording medium. Each of the wiping unit, the scrapping unit, and the platen may be able to be positioned in a first retracted position spaced from and facing a surface of the at least one head chip and a second position adjacent to the print head unit, respectively, and the wiping unit may be able to be positioned in a third scrapping position located between the first position and the second position when the scrapping unit is located in the second position, such that a bottom surface of the scrapping unit contacts the at least one wiper blade of the wiping unit.

Features and/or utilities of the present general inventive concept may also be realized by a print head maintenance system including a print head including at least one head chip to emit ink onto a recording medium, a wiping unit including at least one wiper to wipe a corresponding at least one head chip of the print head, and a scrapping unit to scrap ink from the at least one wiper of the wiping unit. The scrapping unit may include a capping member on a first side facing the print head unit to cap the at least one head chip when the scrapping unit is in a scrapping position.

Features and/or utilities of the present general inventive concept may also be realized by a print head maintenance system including a print head including at least one head chip to emit ink onto a recording medium, a wiping unit including at least one wiper to wipe the at least one head chip, and a wiping unit support member to receive a force from a first direction parallel to a surface of the head chip and to move the wiping unit in a direction perpendicular to the surface of the head chip in response to the force from the first direction.

Features and/or utilities of the present general inventive concept may also be realized by an image-forming apparatus including an image-forming portion including a print head to form an image on a recording medium by emitting ink onto the recording medium and a print head maintenance portion. The print head maintenance portion may include a wiping unit including at least one wiper blade to wipe the at least one head chip of the print head, a scrapping unit to scrap ink from the at least one wiper blade of the wiping unit, and a platen to support a recording medium when the at least one head chip is emitting ink onto the recording medium. The image-forming apparatus may further include a controller to control operation of at least one of the image-forming portion and the print head maintenance portion. Each of the wiping unit, the scrapping unit, and the platen may be able to be positioned in a first retracted position spaced from and facing a surface of the at least one head chip and a second position adjacent to the print head unit, respectively, and the wiping unit may be able to be positioned in a third scrapping position located between the first position and the second position when the scrapping unit is located in the second position, such that a bottom surface of the scrapping unit contacts the at least one wiper blade of the wiping unit.

Features and/or utilities of the present general inventive concept may also be realized by an image-forming apparatus including an image-forming portion including a print head to form an image on a recording medium by emitting ink onto the recording medium and a print head maintenance portion. The print head maintenance portion may include a print head including at least one head chip to emit ink onto a recording medium, a wiping unit including at least one wiper to wipe a corresponding at least one head chip of the print head, and a scrapping unit to scrap ink from the at least one wiper of the wiping unit. The image-forming apparatus may further include a controller to control operation of at least one of the image-forming portion and the print head maintenance portion. The scrapping unit may include a capping member on a first side facing the print head unit to cap the at least one head chip when the scrapping unit is in a scrapping position.

Features and/or utilities of the present general inventive concept may also be realized by an image-forming apparatus including an image-forming portion including a print head to form an image on a recording medium by emitting ink onto the recording medium, a print head maintenance portion, and a controller to control operation of at least one of the image-forming portion and the print head maintenance portion. The print head maintenance portion may include a wiping unit including at least one wiper to wipe the at least one head chip, and a wiping unit support member to receive a force from a first direction parallel to a surface of the head chip and to move the wiping unit in a second direction toward the surface of the head chip in response to the force from the first direction.

Features and/or utilities of the present general inventive concept may also be realized by a method of maintaining a print head, the method including positioning a wiping unit including a wiper blade in a recessed position spaced apart from a print head unit by a first distance, moving the wiping unit in a first direction to a wiping standby position closer to the print head unit than the recessed position, such that the wiper blade is separated from an ink-emitting unit of the print head unit by a second distance less than the first distance, and providing a force to the wiping unit in a second direction perpendicular to the first direction to move the wiper blade in the first direction to contact the ink-emitting unit and in the second direction to move across a surface of the ink-emitting unit while contacting the ink-emitting unit.

The method may further include, after providing the force to the wiping unit in the second direction perpendicular to the first direction, providing a force to the wiping unit in a third direction opposite the second direction to return the wiping unit to the wiping standby position.

BRIEF DESCRIPTION OF THE DRAWINGS

The present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
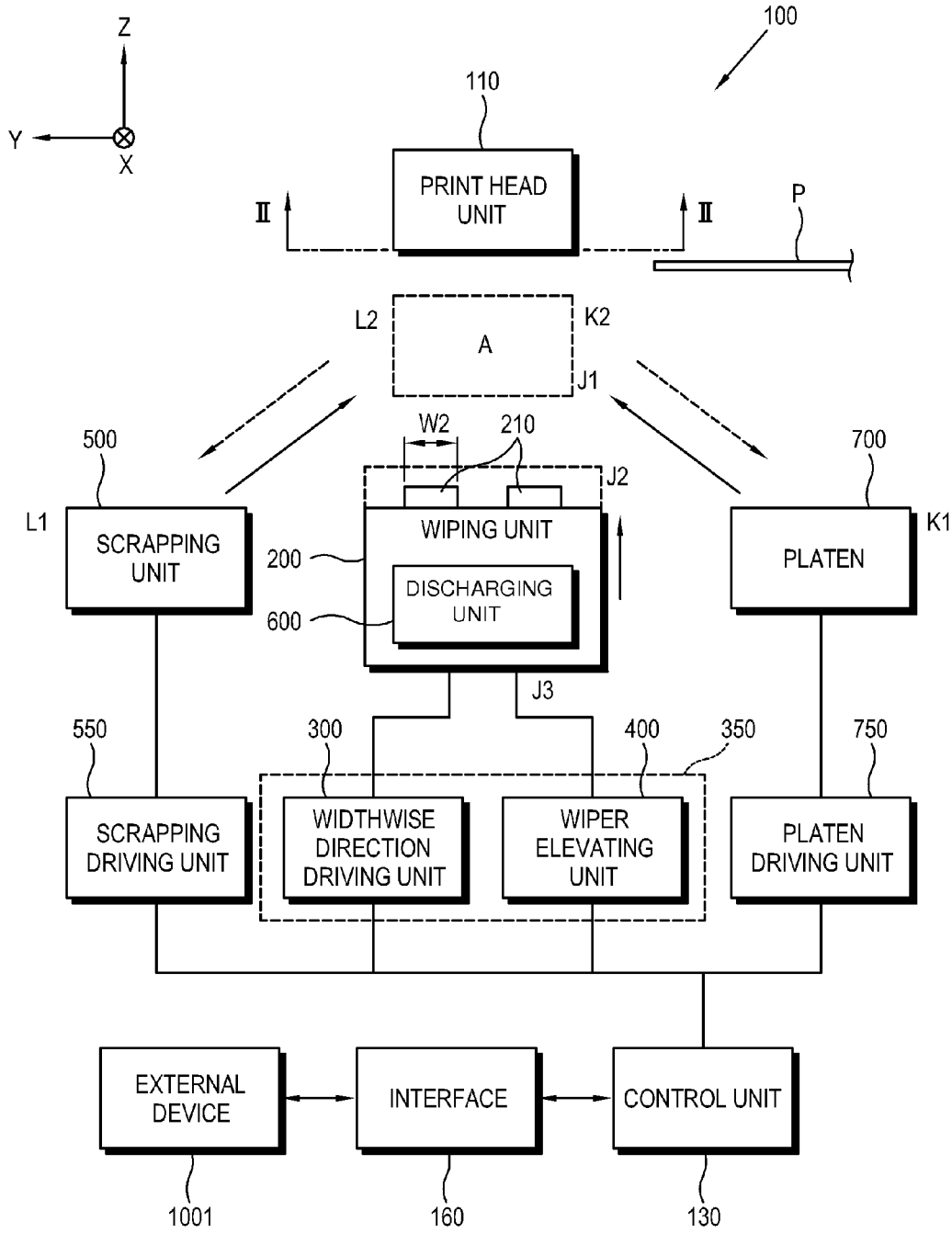
FIG. 1 is schematic block diagram of an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for the convenience of clarity.

FIG. 1 is a schematic block diagram illustrating an image forming apparatus of an inkjet type according to an exemplary embodiment of the present general inventive concept, and FIG. 2 is an enlarged main portion view of a print head unit of the inkjet printer in FIG. 1.

Figure 2A:
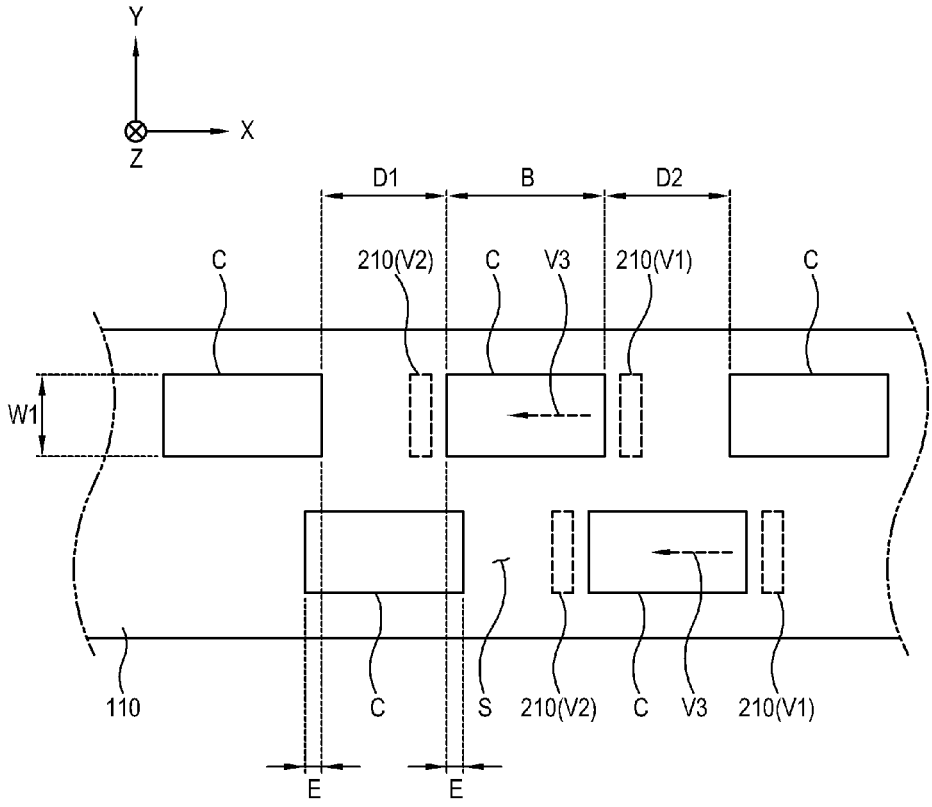
FIG. 2A is an enlarged main portion view of a print head unit of the image forming apparatus in FIG. 1 in line II-II in FIG. 1.

Referring to FIGS. 1 and 2A, an image forming apparatus 100 according to the present general inventive concept includes a print head unit 110 to form an image to a printing medium P, a wiping unit 200 to wipe an ink ejecting surface of the print head unit 110, an ink discharging unit 600 to discharge a scrapped ink generated during a spitting and a scrapping, an elevating driving unit 400 to elevate the wiping unit 200, and a widthwise direction driving unit 300 to move the wiping unit 200 back and forth in a widthwise direction of a printing medium.

The print head unit 110 includes a plurality of head chips C, each having a length corresponding to a widthwise direction X of the printing medium P, and the plurality of head chips C form an image on the printing medium P by ejecting ink onto the printing medium P.

The plurality of head chips C may be arranged in a row in a widthwise direction X of the printing medium and may be distanced from each adjacent head chip C by a predetermined interval D1 and D2, respectively. For example, the plurality of head chips C may be arranged in two rows in a lengthwise direction Y of the printing medium P and may be arranged in an alternating pattern so that an end of a head chip C in one row may overlap an end of a head chip C in the other row by a predetermined interval E in the direction of X-axis. In other words, a length B of a head chip C of a first row of head chips C may be greater than a distance D1 or D2 between two adjacent head chips C of a second row. Consequently, a portion of the head chip C in the first row may overlap a portion of a head chip C in the second row by a distance E in the direction X.

At least one of the wiping unit 200, a scrapping unit 500, a platen 700, and the capping unit 800 may be positioned below the print head unit 110 in a space A to interact with the print head unit 110 depending on an operation of the image forming apparatus. In the disclosure and claims, when one of the maintenance units is referred to as "below" the print head unit, this may refer to a position in which a side of the print head unit 110 including the head chips C is facing "down" so that the maintenance units may face the side including the head chips C. However, it should be understood to one of ordinary skill that the print head unit 110 and maintenance units may have any orientation other than "up" and "down," and that these terms are used only for clarity in describing the spatial relationships between physical structures.

The wiping unit 200 is disposed to move among a first forward position J1 which is a wiping standby position for a wiping operation, a second forward position J2 which is a scrapping position, and a retracted position J3.

That is, the wiping unit 200 moves upwardly along a solid line arrow from the retracted position J3 toward the first forward position J1 if a wiping operation of an ink ejecting surface S of the print head unit 110 is to be performed and moves down along a dotted line arrow from the first forward position J1 toward the retracted position J3 if the wiping operation is completed. Also, the wiping unit 200 moves upward from the retracted position J3 to the second forward position J2 when the scrapping unit 500 is positioned in the lower space A to perform a scrapping operation, and the wiping unit 200 returns to the retracted position J3 after the scrapping operation is completed.

As show in FIGS. 1 to 4, the wiping unit 200 includes a plurality of wiper members 210 arranged in a row in the widthwise direction X of the printing medium P and a support member 220 to support the plurality of wiper members 210. The plurality of wiper members 210 may correspond to the number of the plurality of head chips C of the print head unit 110 so that each wiper member 210 may wipe a corresponding head chip C.

A width W2 of a wiper member 210 in the direction Y corresponding to a length-wise dimension of the printing medium may be equal to or greater than the width W1 of a head chip C in the direction Y. Accordingly, since the width W2 of the wiper member 210 is capable of covering the width W1 of the head chip C, the wiper member 210 can wipe the whole head chip C by moving in the widthwise direction X of the printing medium P.

The plurality of wiper members 210 may be respectively attached to a coupling piece 213, and the coupling piece 213 is detachably coupled to the support member 220 by a coupling means F. Accordingly, if there is a defect to a part of the plurality of wiper members 210, the wiper member 210 can be easily replaced. Alternatively, the plurality of wiper members 210 may be directly coupled to the support member 220 without using the coupling piece 213.

The support member 220 may include a first support member 221 to which the plurality of wiper members 210 are coupled, and a second support member 225 coupled to the first support member 221. Alternatively, the first and second support members 221 and 225 may be integrally formed. In the present specification and claims, the terms "integral with," "integral," "integrally formed," or other similar terms including the term "integral" mean that two or more components are formed in a same process or permanently and inseparably (except by breaking the object) connected to one another. For example, the first and second support members may be integrally formed if they are formed in the same molding process or are welded or bonded to form a single piece.

Figure 4:
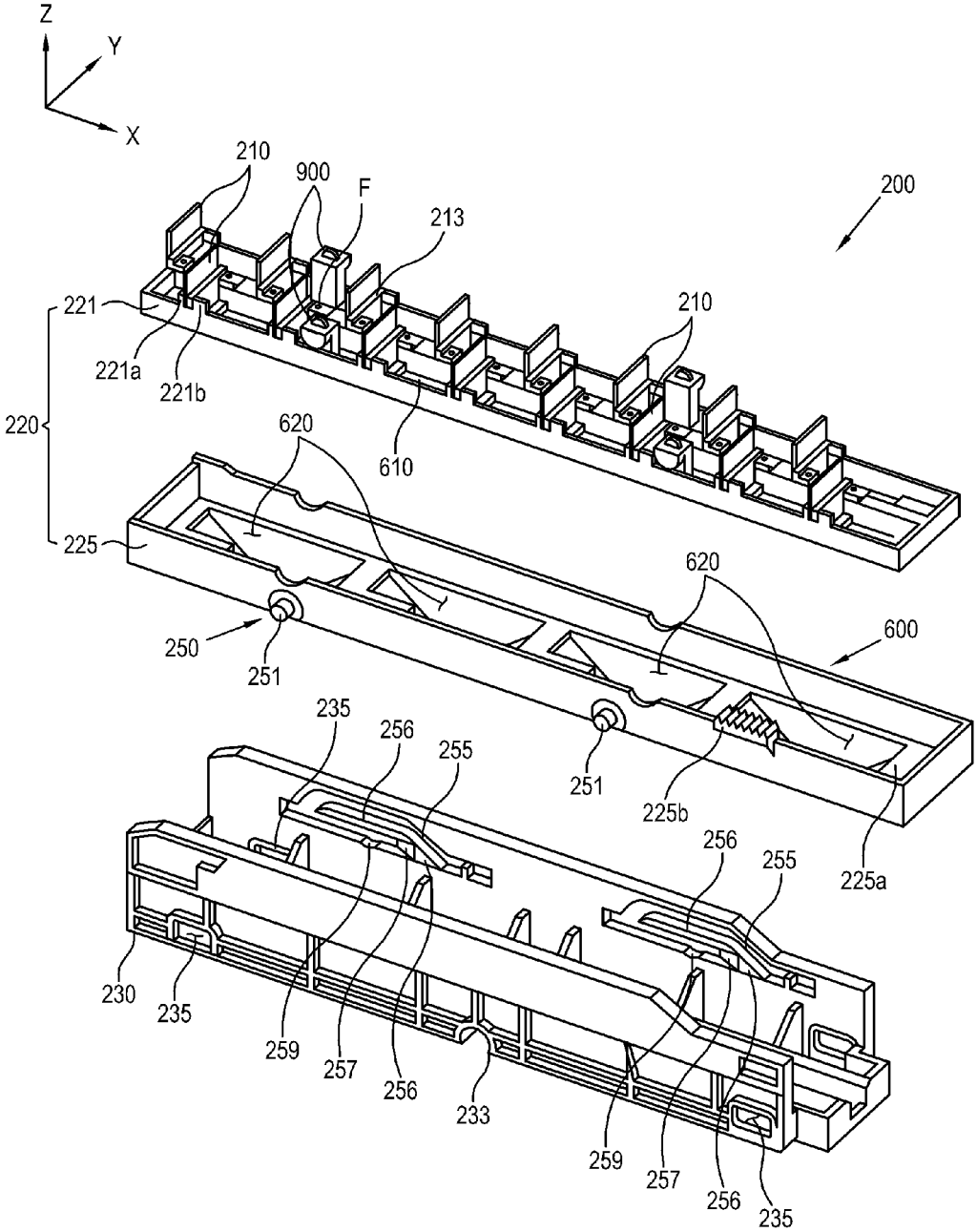
FIG. 4 is an exploded perspective view of a wiping unit of the image forming apparatus in FIG. 1.

Referring to FIG. 4, the first support member 221 includes an insertion unit in which the wiper member 210 coupled to the coupling piece 213 is inserted. This insertion unit may include a pair of insertion protrusions 221*a* and 221*b* having a space between them in which the coupling piece 213 is inserted. The first support member 221 may include a pair of insertion protrusions 221*a* and 221*b* for each wiper member 210, or each coupling piece 213 may hold more than one wiper member 210 so that there may be fewer pairs of insertion protrusions 221*a* and 221*b* than wiper members 210.

The first support member 221 includes a spittoon 610 to receive ink that is spitted during a spitting operation to spit ink from a nozzle of a head chip C after printing to remove excess ink and any foreign materials from the nozzle. The second support member 225 includes an ink accommodating unit 620 to receive the ink from the spittoon and to direct the ink to an ink discharging hole 621 formed in the bottom of the ink accommodating unit 620. The ink discharging hole 621 directs the ink from the ink accommodating unit 620 to a scrapped ink storing unit 630. The spittoon 610, ink accommodating unit 620, and scrapped ink storing unit 630 are all part of the ink discharging unit 600, and additional components and functions of the ink discharging unit 600 will be disclosed below.

Figure 6:
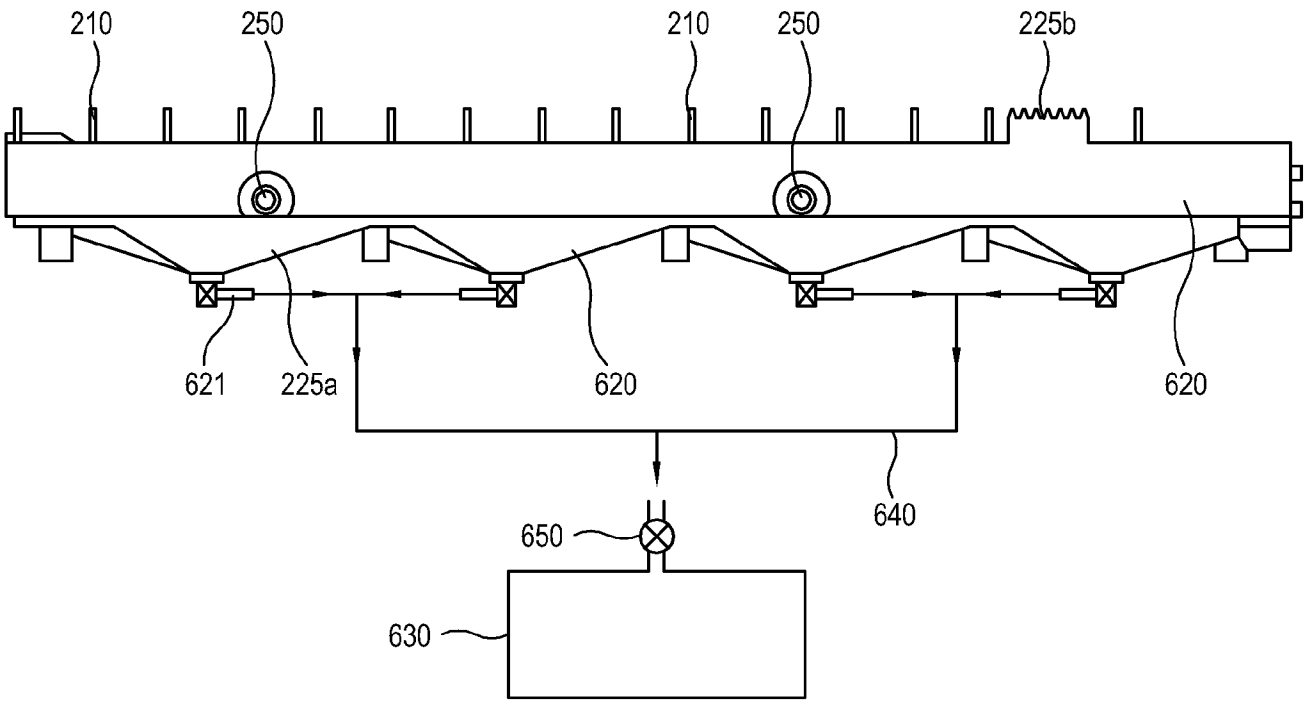
FIG. 6 is a side view illustrating the support member of the wiping unit in FIG. 4.

Referring to FIGS. 4 and 6, the second support member 225 includes a seating surface 225*a* in which the first support member 221 may be seated. If the ink discharging hole 621 of the ink accommodating unit 620 is considered a bottom of the ink accommodating unit 620, then the seating surface 225*a* is located at a top of the ink accommodating unit. The seating surface 225*a* supports a bottom surface of the first support member 221.

Figure 9:
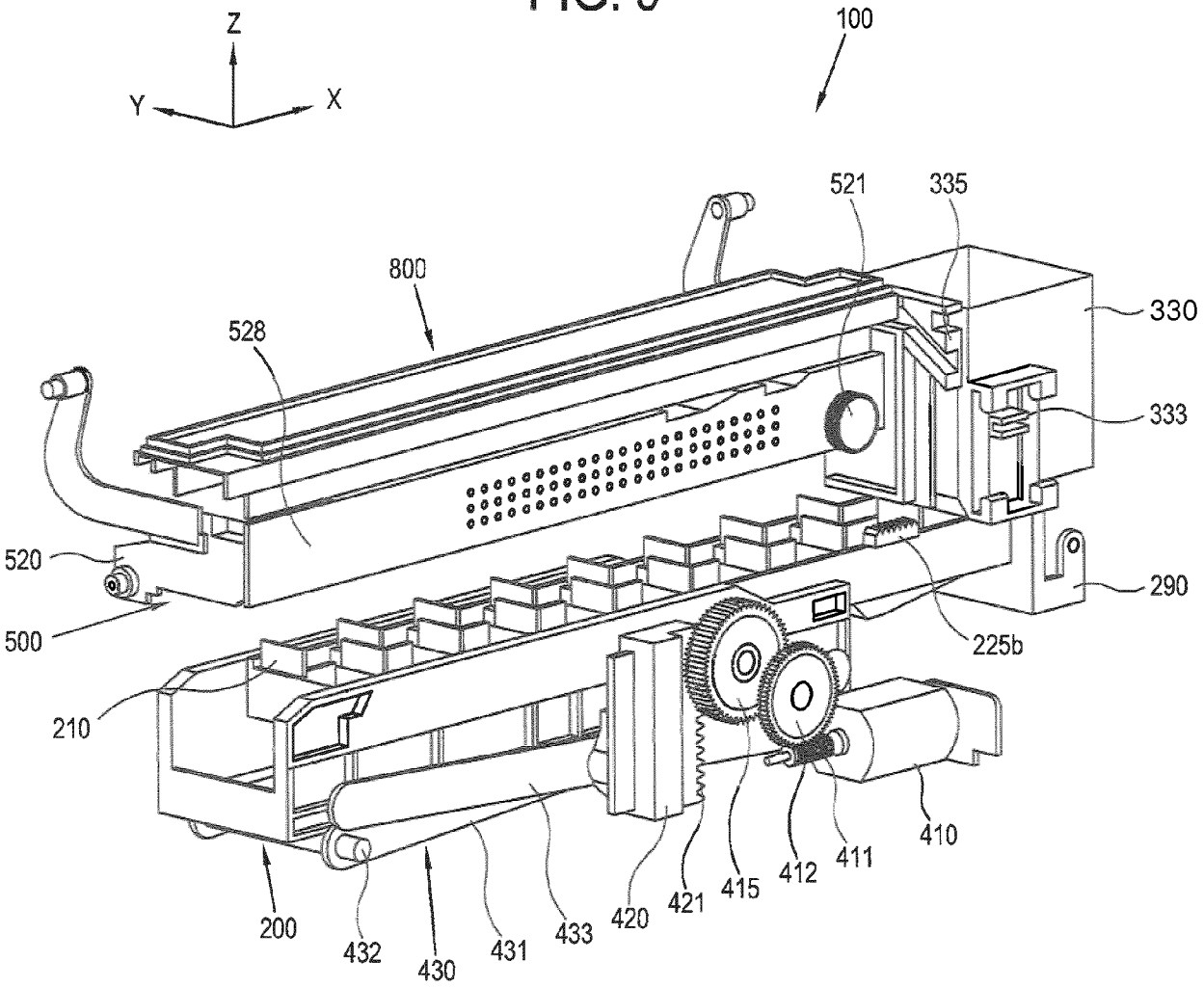
FIG. 9 is a perspective view illustrating a state in which a scrapping unit of the image forming apparatus in FIG. 1 is moved to a cleaning position.

At least one of the first support member 221 and the second support member 225 may further include a wiper rack 225*b* to engage an endless belt driving pinion 521 of a scrapping unit 500, as illustrated in FIG. 9. Accordingly, as the endless belt driving pinion 521 in FIG. 9 and the wiper rack 225*b* are engaged with each other, an endless belt 510 in FIG. 10 of the scrapping unit 500 circulates to interlock with a movement in the widthwise direction X of the printing medium of the support member 220. A driving mechanism of the scrapping unit will be described below with reference to FIGS. 11A-11D.

The wiping unit 200 may further include a wiper frame 230 to support the support member 220. A guide unit 250 including a guide protrusion 251 may be located on the support member 220 to interact with a guide groove 255 of the wiper frame 230 to elevate each of the plurality of wiper members 210 when the support member 220 is moved in the widthwise direction X of the printing medium P by the widthwise direction driving unit 300.

Specifically, as shown in FIGS. 7 and 2B-2E, the guide unit 250 guides the plurality of wiper members 210 to move upwardly from the first forward position J1 to a position contacting to the ink ejecting surface of the print head unit 110, to move across a surface of the head chips C, and to move back to the first forward position J1.

The guide protrusion 251 may be located on one of the wiper frame 230 and the support member 220, and the guide groove 255 is located on the other of the wiper frame 230 and the support member 220. Since the elevation of the guide protrusion 251 with respect to the print head unit 110 is regulated by the guide groove 255, the wiper member 210 can elevate towards the print head unit 110 when the support member 220 moves in the widthwise direction X (A2) of the printing medium with respect to the wiper frame 230.

A plurality of guide protrusions 251 may be located on opposite sides of the second support member 225 spaced apart from each other in the widthwise direction X of the printing medium. FIG. 4 illustrates an example in which two guide protrusions 251 are respectively provided on a side of the second support member 225, but the number thereof may be appropriately changed.

Referring to FIGS. 2B-2E and 7, the guide groove 255 is provided to guide the guide protrusion 251 from a standby position H5 to a first position H1, a second position H2, a third position H3, a fourth position H4, and back to the original standby position H5. A seating groove 259 may be formed in the guide groove 255 to secure the guide protrusion 251 in the standby position H5. As necessary, the standby position H5 may be omitted, and the first position H1 or the fourth position H4 may be provided to perform a function as a standby position.

When the guide protrusion 251 is moved from the standby position H5 through the first H1, second H2, third H3, and fourth H4 positions, and back to the standby position H5, the plurality of wiper members 210 respectively perform a wiping operation to wipe each ink ejecting surface S of the print head unit 110. The guide groove 255 includes a first protrusion 256 that is inclined to guide the guide protrusion 251 upward onto a second protrusion 257 that guides the guide protrusion 251 in a horizontal direction.

The portion of the guide groove 255 above the second protrusion 257 is closer to the print head unit 110 than the portion of the guide groove 255 below the second protrusion 257 which corresponds to the wiping standby position J1. Thus, when the guide protrusion 251 is located in the second and third positions H2 and H3 above the second protrusion 257, the first support member 221 including the wiping members 210 is moved into a position in which the wiping members 210 may contact the print head unit 110.

Figure 2B:
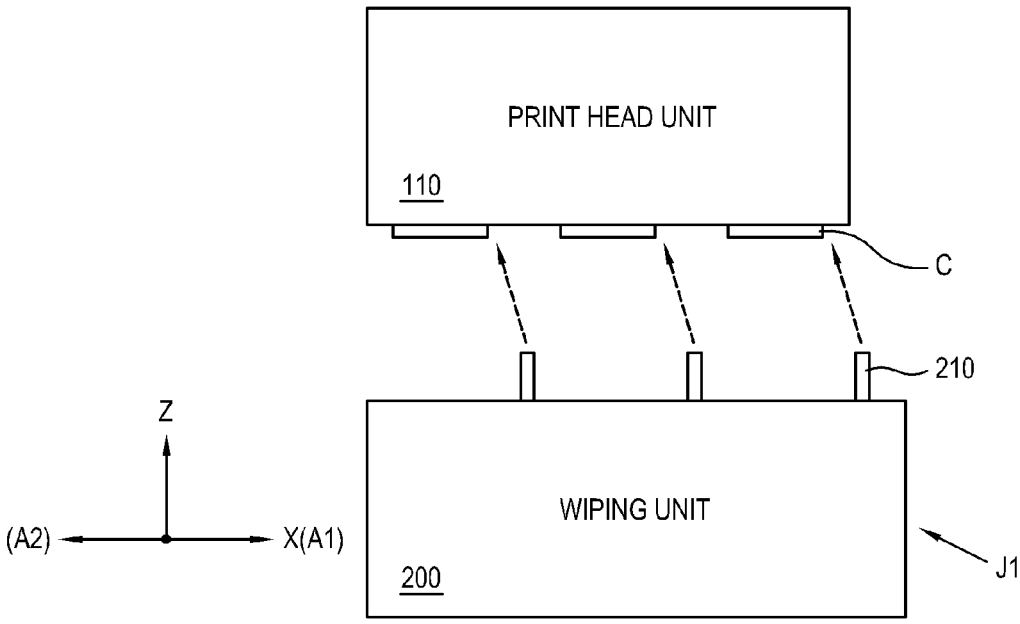
FIGS. 2B-2E are side views of the print head unit and the wiping unit of FIG. 1 during a wiping operation.
Figure 7:
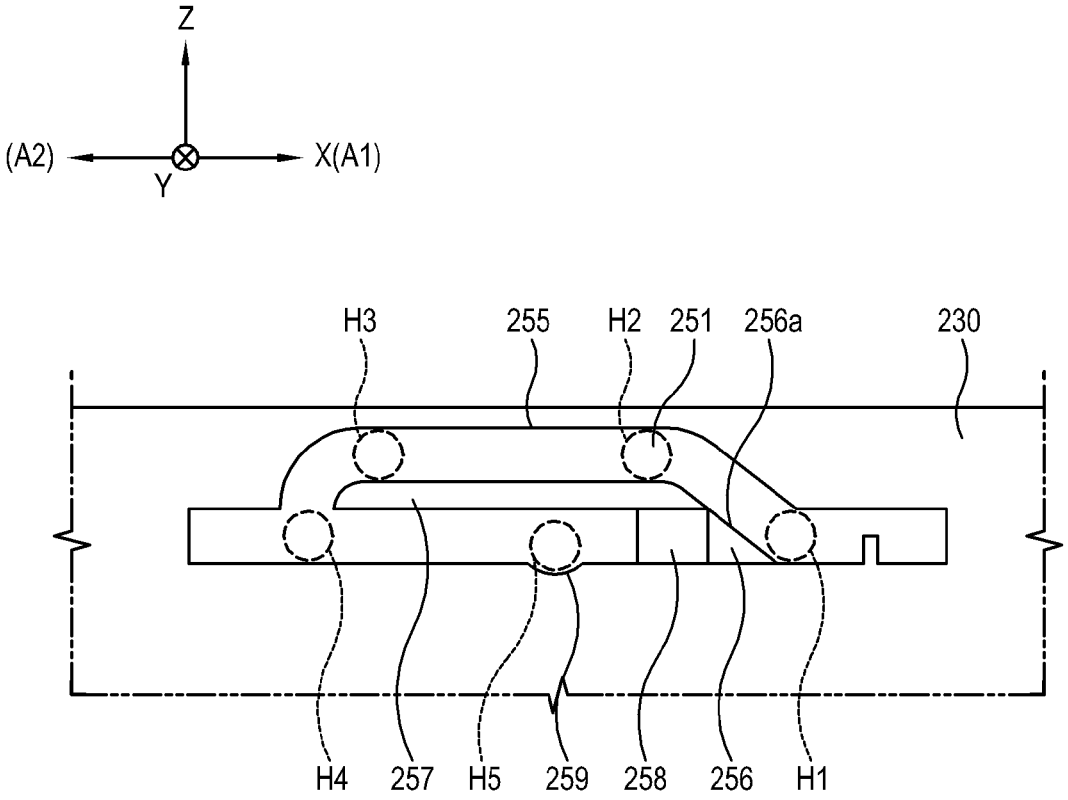
FIG. 7 is a schematic view for illustrating a position relation of a guide unit of the wiping unit in FIG. 4.

When the wiping member is moved from a retracted position J3 to the first forward position J1, the guide protrusion may be located in the first position H1 of FIGS. 2B and 7. The width-wise direction driving unit 300 may apply a force to the wiper support member 220 in the direction A2 to move the guide protrusion 251 from the first position H1 to the second position H2 along an inclined surface 256*a* of the first protrusion 256 so that the wiper member 210 can move upwardly to a wiping position.

Although the present example illustrates a wiping operation with the width-wise direction driving unit 300 applying a force to a portion of the wiper support member 220 having the guide protrusion 251, the width-wise direction driving unit may alternatively apply a force to a portion of the wiper support member 220 that has the guide groove 255 formed therein. In such a case, the width-wise direction driving unit 300 would apply a force in the direction A1 opposite the direction A2 to move the guide protrusion up the incline 256*a*.

Figure 2C:
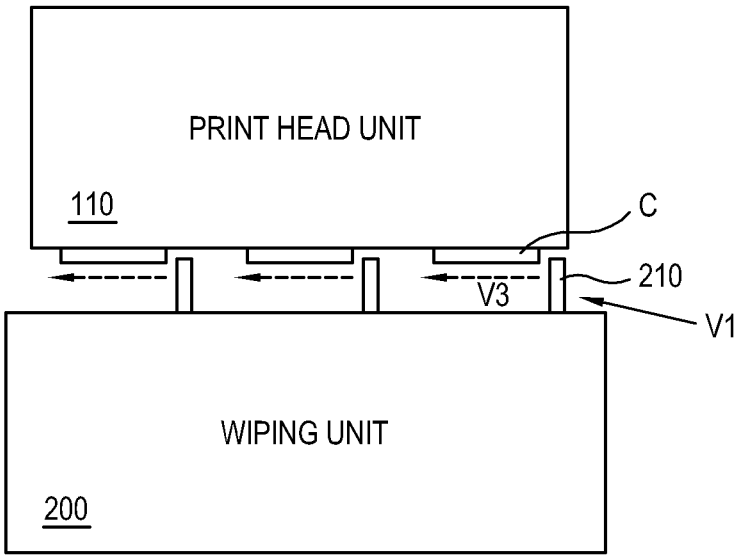

Referring to FIGS. 2C and 7, if the width-wise direction driving unit 300 continues to apply a force in the direction A2 to the portion of the wiper support member 220 having the guide protrusion 251, the guide protrusion 251 moves from the second position H2 to the third position H3 in a direction A2 substantially parallel to the widthwise direction X of the printing medium. The distance between the second position H2 and the third position H3 may be equal to or more than the length B in the widthwise direction X of the head chip C. Accordingly, as the guide protrusion 251 moves from the second position H2 to the third position H3, a wiper member 210 may wipe an entire surface of a corresponding head chip C.

Figure 2D:
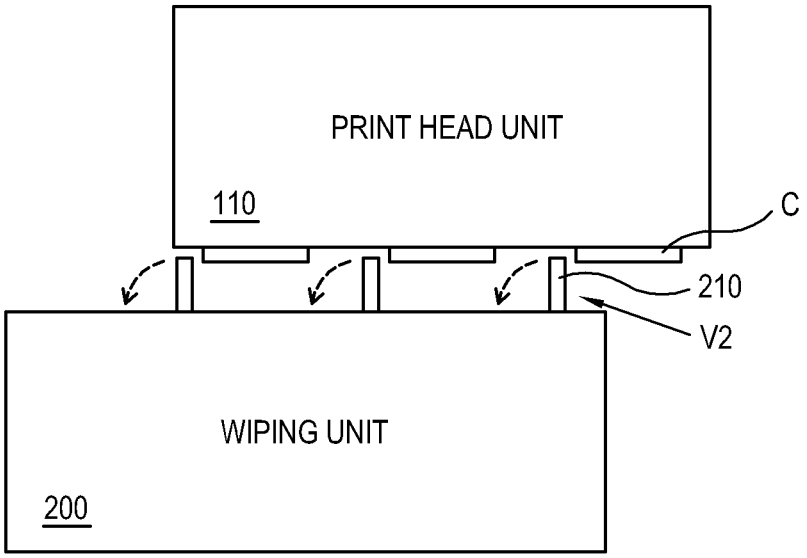

As illustrated in FIGS. 2D and 7, as the support member 220 continues moving in the same direction A2, the guide protrusion 251 drops off an end of the second protrusion 257 to the fourth position H4. The fourth position H4 may be at a lower portion of the guide groove 255 so that the wiper unit 200 is at a level corresponding to the first forward position J1.

Figure 2E:
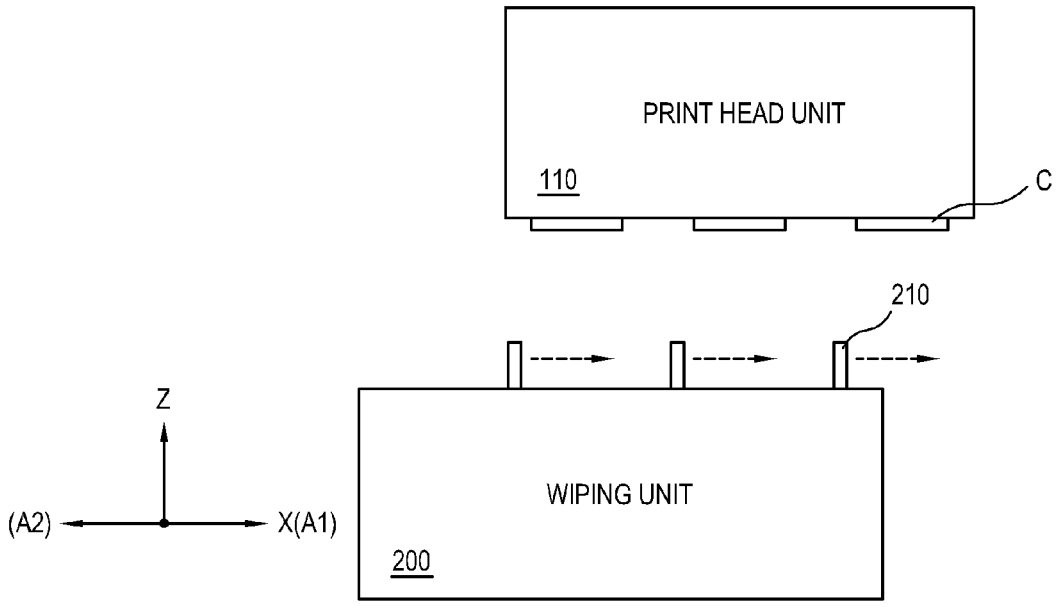

Referring to FIGS. 2E and 7, when the guide protrusion 251 is at the fourth position H4 and the width-wise driving unit 300 drives the support member 220 in the direction A1 opposite the direction A2, the guide protrusion 251 moves along a guide path of the guide groove 255 below the second protrusion 257 until it reaches the fifth position H5, thereby completing a wiping operation.

Then, in the wiping operation of the next cycle, the guide protrusion 251 is shifted in the lengthwise direction Y of the printing medium along an inclined surface 258 inclined in the lengthwise direction Y of the printing medium P to pass along the first protrusion 256 to move from the standby position H5 to the first position H1.

The guide protrusion 251 may be located on the first support member 221, or it may be part of both the first and second support members 221 and 225. Alternatively, the guide protrusion 251 may be located on the wiper frame 230, and the guide groove 255 may be located on an outer surface of the second support member 225.

The guide protrusion 251 may be formed integrally with either the first support member 221 or the second support member 225, or it may be mounted to either the first or second supporting members 221 or 225. The guide protrusion 251 may be a solid structure, or it may be a retractable element that protrudes as it is moved through the guide groove 255 and retracts as it moves over the inclined surface 258 between the standby position H5 and the first position H1.

The wiper frame 230 may further include an elevating rack protrusion insertion unit 233 into which an elevating rack protrusion 423 of an elevating driving unit 400 is inserted, and a connecting rod insertion hole 235 provided in an elongated hole along the widthwise direction of a printing medium so that a connecting rod 432 can be inserted therethrough. The ink discharging unit 600 accommodates and discharges ink used in a spitting operation and any foreign material generated in a wiping operation of the print head unit 110. The ink discharging unit 600 includes the spittoon 610 provided in the first support member 221, the ink accommodating unit 620 to accommodate ink discharged from the spittoon 610, a scrapped ink storing unit 630, and a discharging driving source 650.

Figure 5:
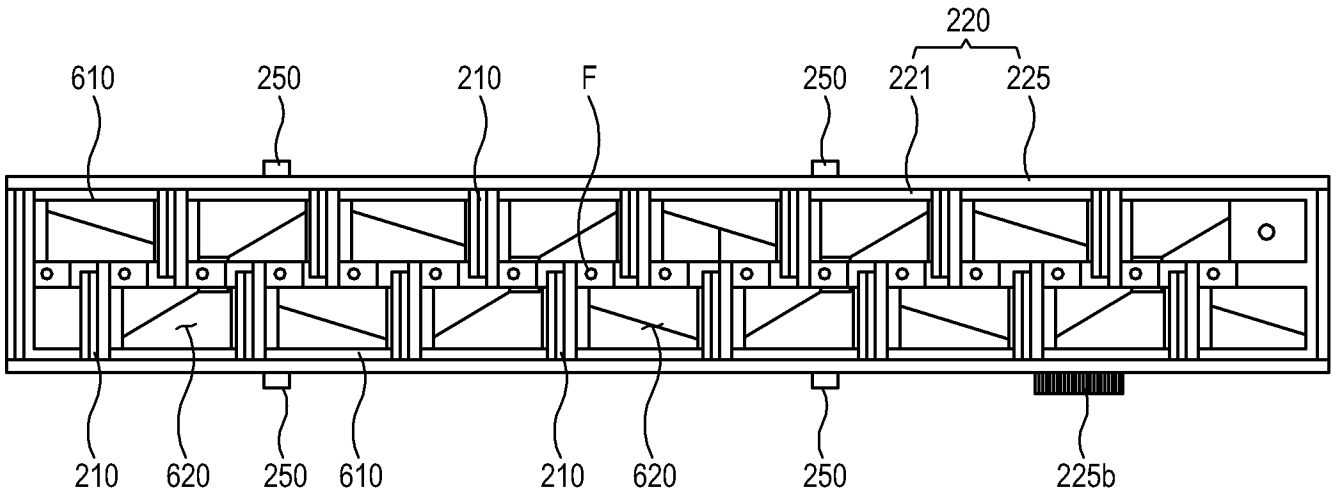
FIG. 5 is a schematic plain view illustrating a wiper member and a support member of the wiping unit in FIG. 4.

The ink accommodating unit 620 includes a plurality of accommodating spaces, each accommodating space located at a position corresponding to at least one head chip among the plurality of head chips C. The scrapped ink discharging unit 600 may concurrently discharge the scrapped ink from the accommodating spaces to the scrapped ink storing unit 630. Referring to FIGS. 5 and 6, the ink accommodating unit 620 includes eight accommodating spaces positioned to correspond to two head chips, and the ink discharging hole 621 is formed at a lower part of each accommodating space. The scrapped ink accommodating unit 620 may have a shape inclined toward the ink discharging hole 621 so that scrapped ink accommodated in the scrapped ink accommodating unit 620 can be gathered toward the ink discharging hole 621.

The scrapped ink storing unit 630 is connected with the scrapped ink accommodating unit 620 through an ink discharging path 640. The discharging driving source 650 is provided on an ink discharging path 640 between the ink accommodating unit 620 and the scrapped ink storing unit 630 and discharges scrapped ink from each of the plurality of accommodating spaces to the scrapped ink storing unit 630.

Figure 3:
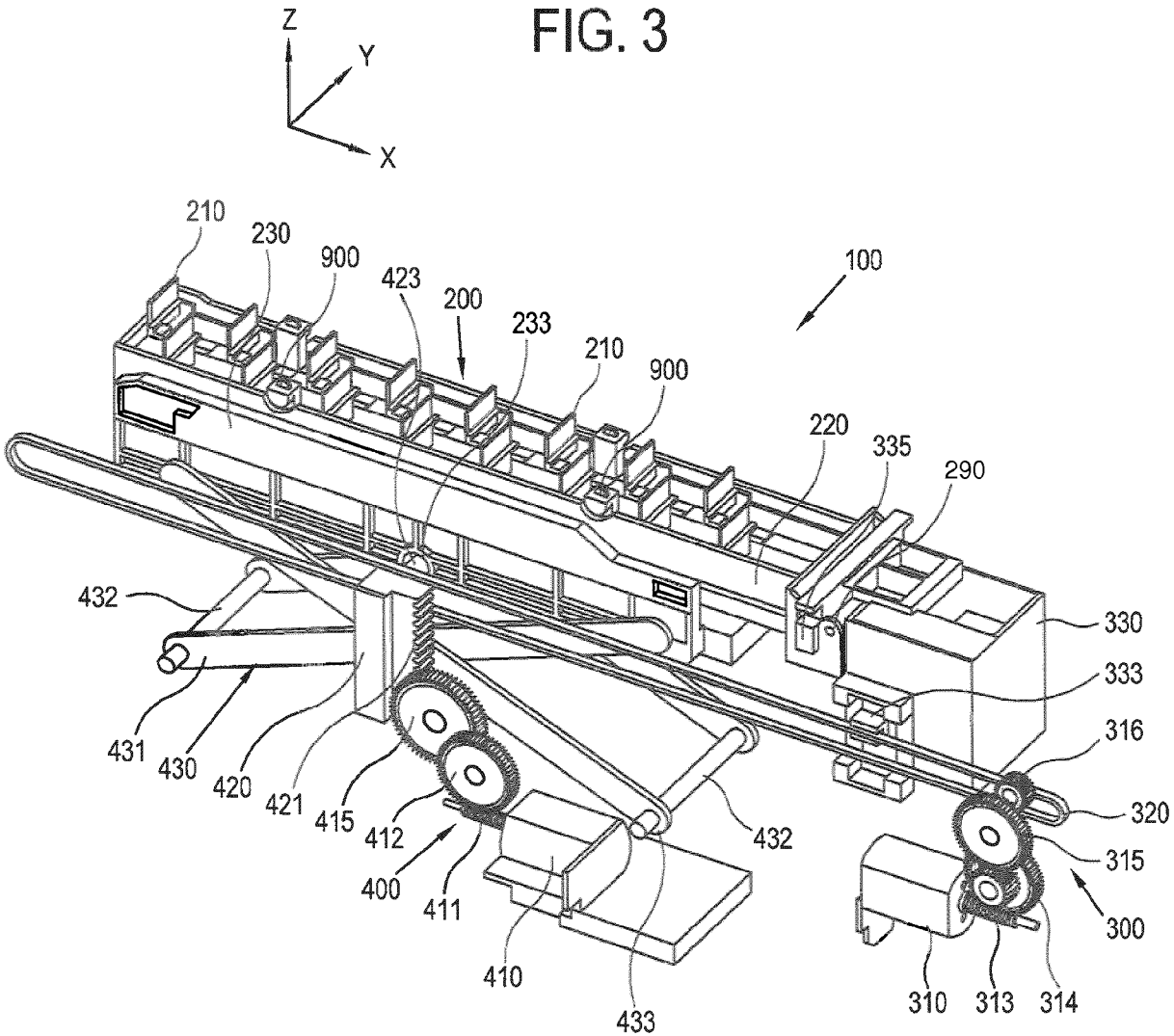
FIG. 3 is an enlarged main portion perspective view of the image forming apparatus in FIG. 1.

The wiping unit 200 may be moved from the retracted position J3 to the first forward position, or the wiping standby position J1, by an elevating driving unit 400. The elevating driving unit 400 may also elevate the wiping unit 200 to the scrapping position J2, which will be described below. Referring to FIG. 3, the elevating driving unit 400 includes an elevating rack 420, an elevating driving source 410, and a folding unit 430. The elevating rack 420 includes the elevating rack protrusion 423 inserted in the elevating rack protrusion insertion unit 233 of the wiper frame 230. The elevating rack protrusion insertion unit 233 may be provided to a middle portion of the wiper frame 230, for example.

In FIG. 4, a side of the elevating rack protrusion insertion unit 233 is illustrated as opened, but may be closed as necessary.

The elevating driving source 410 supplies a driving force for moving the elevating rack 420 in an upward and downward direction Z in FIG. 2. The folding unit 430 supports the wiping unit 200, and is unfolded when the wiping unit 200 moves upwardly and is folded when the wiping unit 200 moves downwardly.

A driving force of a worm gear 411 located on a driving shaft of the elevating driving source 410 is transmitted to a pinion (not shown) through relaying gears 412 and 415. The pinion is disposed coaxially with the relaying gear 415 to be engaged with a rack teeth 421 of the elevating rack 420. Accordingly, as the elevating rack 420 moves upwardly and downwardly depending on the rotation direction of the pinion, the wiping unit 200 to which the elevating rack 420 is connected moves upward and downward.

Figure 8A:
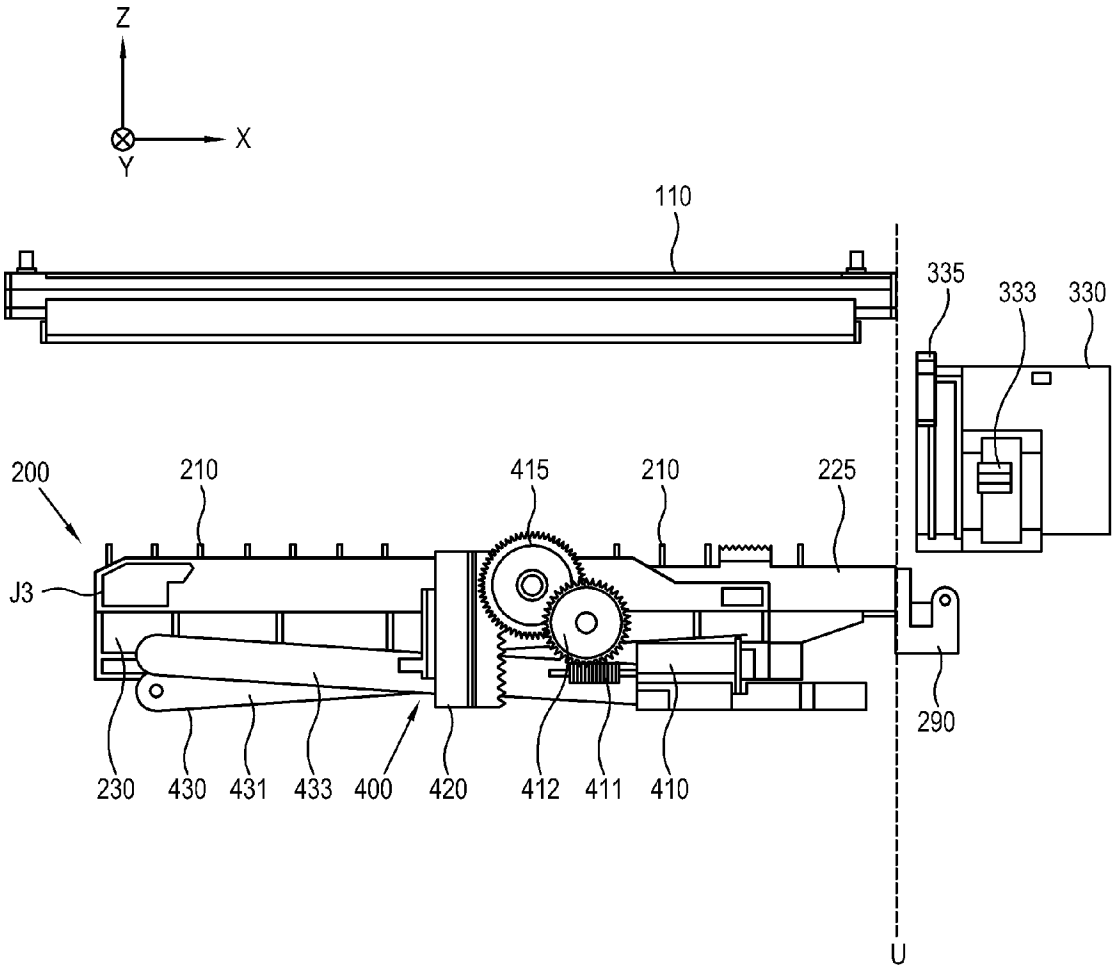
FIGS. 8A-8E illustrate in order processes of a wiping operation of the image forming apparatus in FIG. 1.

Referring to FIGS. 8A through 8E and 9, the folding unit 430 includes one pair of cross bars 431 and 433 in FIG. 8A crossing each other in an X shape in each of the opposite sides of the wiper frame 230, and a first connecting rod 432 movably connected to a main body of the image forming apparatus and rotatably supporting an end part of the cross bar 431. The first connecting rod 432 is coupled to an elongated hole (not shown) formed to the main body of the image forming apparatus in the widthwise direction X of the printing medium, and is capable of freely moving by the length of the elongated hole.

Among the plurality of connecting rods, a second connecting rod (not shown) positioned in an upper side is inserted to the connecting rod insertion hole 235 in FIG. 4 of the wiper frame 230 to be movable in the widthwise direction X of the printing medium. Accordingly, if the wiping unit 200 is elevated upward and downward, an end part height of the folding unit 430 varies by the elevating driving unit 400 so that wiping unit 200 can elevate upward toward the print head unit 110 and downward away from the print head unit 110.

The widthwise direction driving unit 300 moves the support member 220 of the wiping unit 200 back and forth along the widthwise direction X of the printing medium. That is, the widthwise direction driving unit 300 moves the wiping unit 200 into the first forward position J1 or the second forward position J2.

As shown in FIGS. 3 and 8A, the widthwise direction driving unit 300 includes a shuttle 330 capable of moving the wiping unit 200 back and forth in the width-wise direction X of the printing medium. The width-wise direction driving unit 300 may include a first engagement unit 335 and a shuttle driving source 310 to drive the shuttle 330. The wiping unit 200 may include a second engagement unit 290 on the support member 220 to engage with the first engagement unit 335 when the wiping unit 200 is positioned in the first forward position J1 or the second forward position J2. The second engagement unit 290 may be released from the first engagement unit 335 when the wiping unit 200 moves to the retracted position J3.

The widthwise direction driving unit 300 may further include a driving belt 320 driven by the shuttle driving source 310 to circulate along the widthwise direction X of the printing medium, and a clamper 333 disposed to the shuttle 330 to clamp the driving belt 320.

A worm gear 313 is located on a driving shaft of the shuttle driving source 310, and a driving force of the worm gear 313 is transmitted to a driving pulley 316 driving the driving belt 320 via relaying gears 314 and 315.

Also, the image forming apparatus 100 according to the present general inventive concept may further include a stopper to maintain a uniform contacting force between the head chip and the wiper when the plurality of wiper members contact the ink ejecting surface to perform the wiping operation. Referring to FIG. 4, the stopper 900 may be located on an upper surface of the wiping unit 200 facing the print head unit 110 and may be embodied as a plurality of rollers so that the first support member 221 can freely move in the widthwise direction of the printing medium. Thus, a wiper member 210 may maintain a uniform contacting force against an ink ejecting surface S of the print head unit 110.

Also, as shown in FIG. 1, the image forming apparatus 100 according to the present general inventive concept may include the platen 700 and a platen driving unit 750. The platen 700 may move between a support position K2 to support a printing medium P to be printed on by ink ejected from the ink ejecting surface S and a first standby position K1 retracted from the support position K2. The platen driving unit 750 drives the platen 700 so that the platen 700 moves between the first standby position K1 and the printing medium support position K2 depending on an operation mode. The platen driving unit 750 is controlled by the control unit 130 so that the platen 700 can be positioned in the support position K2 in a normal state. Accordingly, the platen 700 may be efficiently moved from the retracted position K1 to the support position K2 to perform a printing operation.

Also, the image forming apparatus 100 according to the present general inventive concept may further include the scrapping unit 500 to clean the plurality of wiper members 210 and a scrapping driving unit 550.

As shown in FIG. 1, the scrapping unit 500 may be positioned below the print head unit 110 to move between a second standby position L1 and a cleaning position L2 to clean the plurality of wiper members 210.

Figure 10:
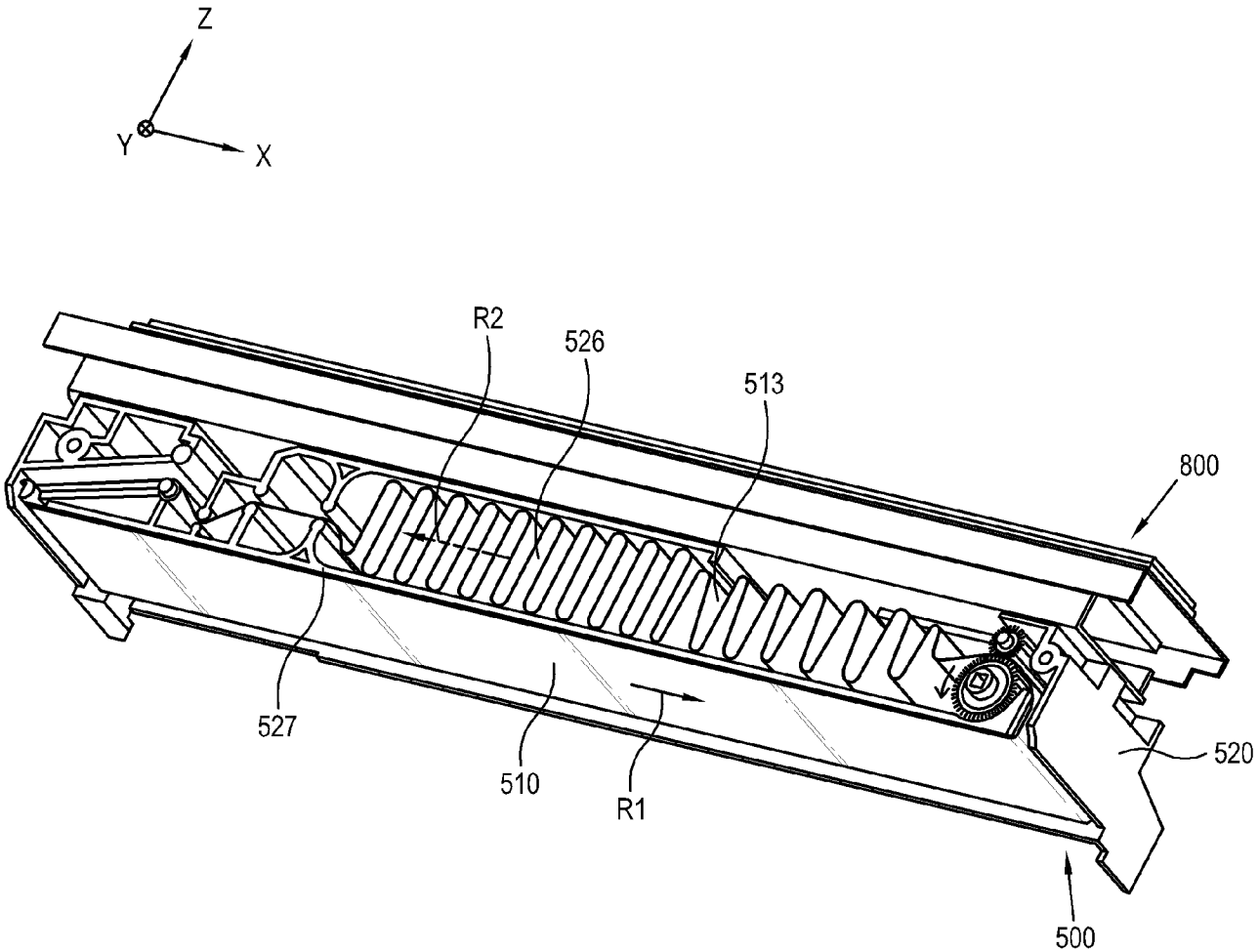
FIG. 10 is an enlarged main portion perspective view of the scrapping unit in FIG. 9.

As shown in FIGS. 9 and 10, the scrapping unit 500 includes the endless belt 510 and a belt support frame 520. FIG. 10 is an enlarged main portion perspective view illustrating the belt support frame 520 of FIG. 9 with a cover 528 removed.

The endless belt 510 wipes scrapped ink or foreign materials attached to a front end part in the upward direction Z of the plurality of wiper members 210. The endless belt 510 may be formed of cloth having a good liquid absorbability such as cotton.

The endless belt 510 circulates so that a portion of the endless belt 510 is exposed in a direction facing the plurality of wiper members 210 and the rest of the endless belt 510 is not exposed to the wiper members 210.

The belt support frame 520 accommodates the endless belt 510 and includes a belt support surface 527 to support the endless belt 510 so that the endless belt 510 can be unfolded in the exposed position and a storing space 526 to store the portion of the endless belt 510 that is not exposed to the wiper members 210.

Since the endless belt 510 is stored in the storing space 526 in the folded state, the endless belt 510 may be longer, and accordingly, a length of time between replacements of the endless belt 510 may be increased.

Also, as shown in FIG. 1, the scrapping driving unit 550 drives the scrapping unit 500 so that the scrapping unit can move between the cleaning position L2 in which the scrapping unit 500 is positioned in the lower area A of the print head unit 110 to clean the plurality of wiper members 210, and the second standby position L1.

Also, the image forming apparatus 100 according to the present general inventive concept may further include a capping unit 800.

FIG. 1 illustrates a case in which the scrapping unit 500, wiping unit 200, and platen 700 each have a separate driving unit, 550, 350, and 750, respectively. However, two or more maintenance units or operational units, such as the platen 700 and the scrapping unit 500, may share a driving unit. In addition, while FIG. 1 illustrates an embodiment in which the wiping unit 200 is located directly beneath the print head 110, any of the maintenance or operation units may be located beneath the print head 110.

In addition, the control unit 130 may be connected to an interface 160 which may either receive input directly from the image-forming device 100, such as via a user input or screen, or it may transmit data to/from an external device 1001 either via a wire or wirelessly.

The ink discharging unit 600 may be entirely separate from the wiping unit 200, or portions of the discharging unit 600, such as spittoons 610 and ink accommodating units 620 may be part of the wiping unit 200 while other portions, such as the scrapped ink storing unit 630 may be separate.

In addition, as illustrated in FIG. 1, the wiping unit 200 may be driven by a single wiping unit driving unit 350 which may move the wiping unit 200 upward in the direction Z toward the print head 110 and in a lateral or width-wise direction X with respect to the print head 110. Alternatively, the wiping unit driving unit 350 may include the width-wise driving unit 300 and the wiper elevating unit 400.

Figure 11A:
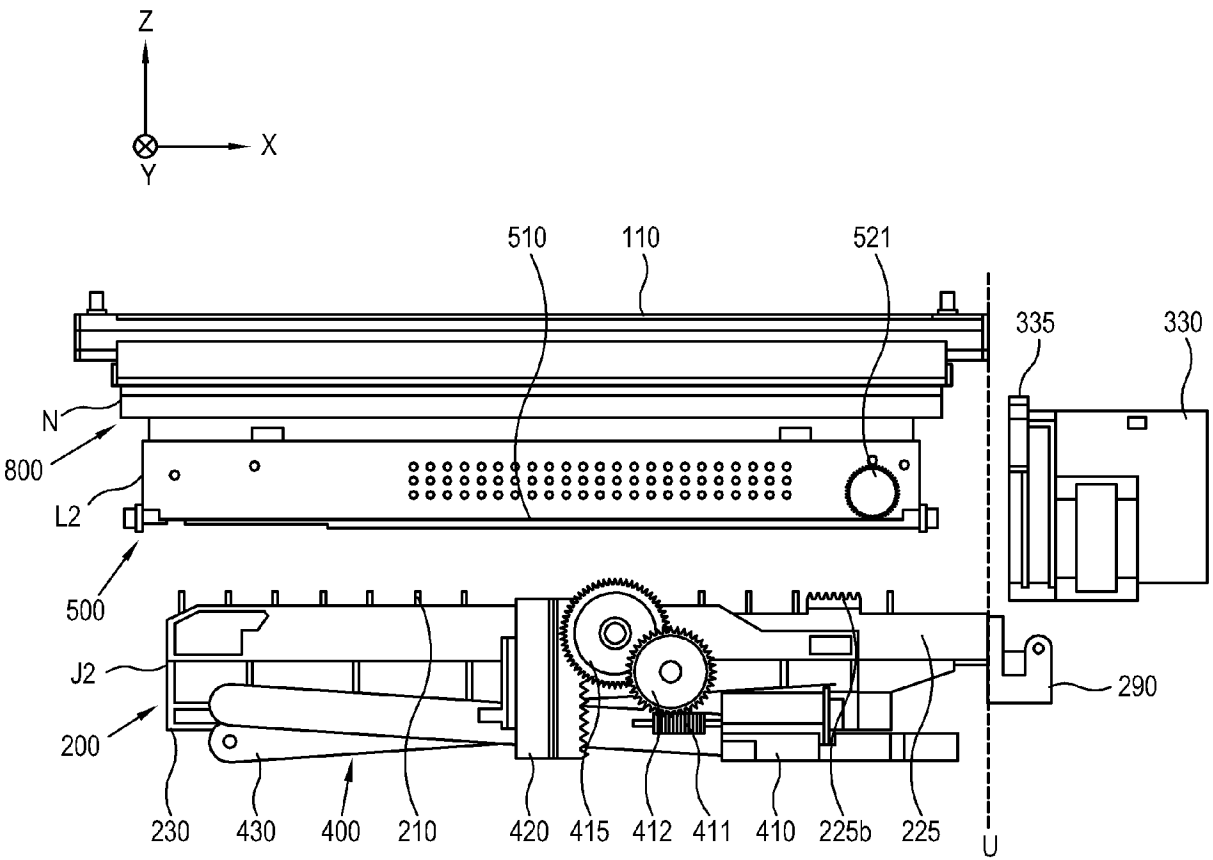
FIGS. 11A-11D illustrate a scrapping operation of the image forming apparatus in FIG. 1.

As shown in FIGS. 9, 10, and 11A, the capping unit 800 may be located on an upper side of the scrapping unit 500 to move between the capping position N to cap the ink ejecting surface S of the print head unit 110 and the third standby position retracted from the capping position N to interlock with a moving of the scrapping unit 500 between the cleaning position L2 and the second standby position L1. Accordingly, while a printing operation is not performed, the capping unit 800 may cap the ink ejecting surface S to prevent the nozzle of the array head unit 110 from being polluted.

As described above, if the capping unit 800 is provided to an upper side of the scrapping unit 500, since a separate driving unit for driving the capping unit 800 is unnecessary, the total configuration can be simplified. Alternatively, the capping unit 800 may be configured to operate independently with respect to the scrapping unit 500 by a separate driving source.

Also, as shown in FIG. 1, the image forming apparatus 100 according to the present general inventive concept may further include a control unit 130 to control the elevating driving unit 400, the widthwise direction driving unit 300, and the scrapping driving unit 550 to perform at least one of the wiping operation, the spitting operation, the scrapping operation, and the capping operation.

Hereinafter, processes of the wiping operation and the spitting operation will be described in detail by referring to FIGS. 8A to 8E. In FIGS. 8A to 8E, a reference position U is indicated to illustrate a movement degree of the printing medium in the widthwise direction X of the support member 220 and the shuttle 330.

Referring to FIG. 8A, the wiping unit 200 may be positioned in the retracted position J3 when the wiping operation and the scrapping operation are not performed.

Figure 8B:
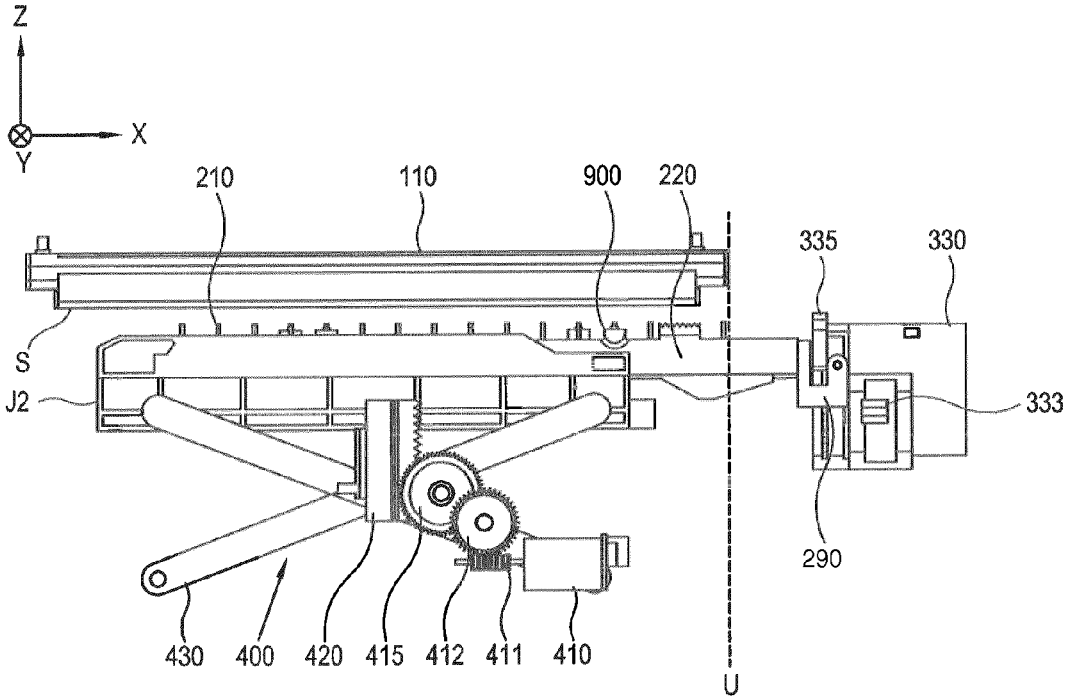

If the wiping operation is to be performed, as shown in FIG. 8B, the control unit 130 controls the elevating driving unit 400 so that the plurality of wiper members 210 move in an upward direction Z to the second forward position J2. Accordingly, the second engagement unit 290 is engaged with the first engagement unit 335 of the shuttle 330. If the wiping unit 200 is positioned in the second forward position J2, the plurality of wiper members 210 do not contact to the ink ejecting surface S. That is, there exists a predetermined interval between each of the plurality of wiper members 210 and the print head unit 110.

Then, as the control unit 130 drives the shuttle 330, and the shuttle 330 moves in the widthwise direction X of the printing medium, the support member 220 also moves in the widthwise direction X of the printing medium with respect to the wiper frame 230. Accordingly, as illustrated in FIGS. 4 and 7, the guide protrusion 251 interacts with the guide groove 255 to move from the standby position H5 to the first position H1.

Figure 8C:
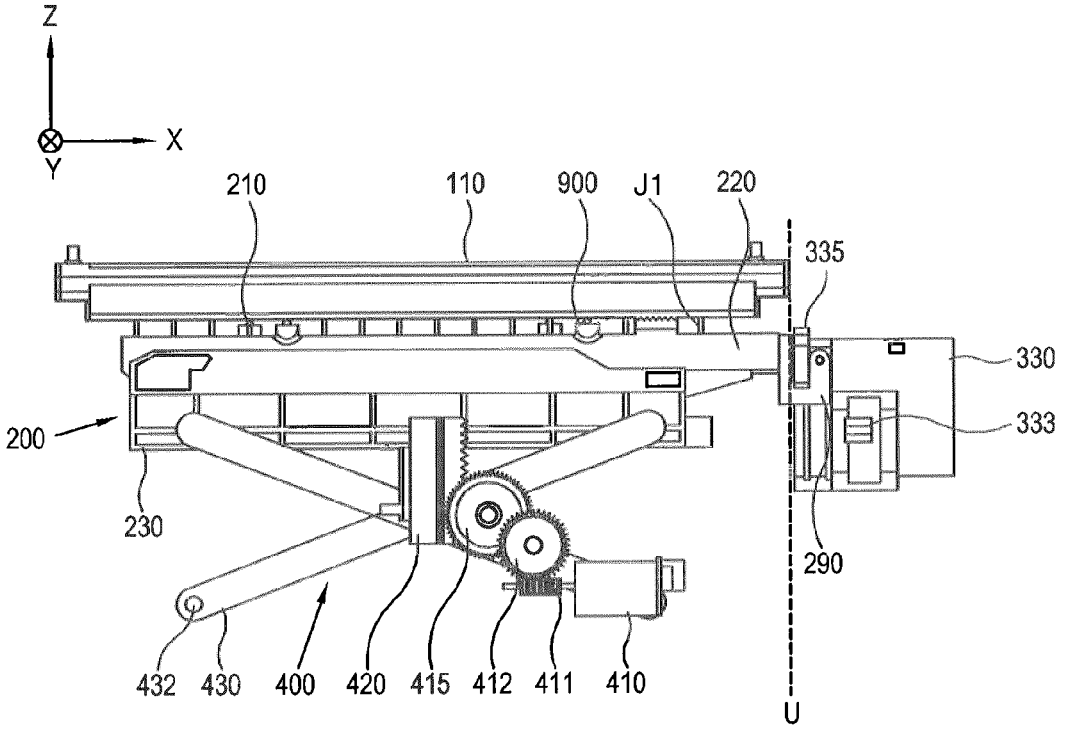

Then, as illustrated in FIG. 8C, the control unit 130 controls the widthwise direction driving unit 300 to move the support member 220 in the opposite direction to the widthwise direction X of the printing medium. As illustrated in FIGS. 2, 4, and 7, the guide protrusion 251 interacts with the guide groove 255 to move from the first position H1 to the second position H2. Since there is a height difference between the first position and the second position, by the above movement, the plurality of wiper members 210 on an upper side of the support member 220 moves upwardly to the first forward position J1 and contacts a first contact position V1 of the ink ejecting surface S.

As illustrated in FIGS. 2A, 4, and 7, as the guide protrusion 251 moves from the second position H2 to the third position H3, and each wiper member 210 wipes the ink ejecting surface S of the corresponding head chip C of the print head unit 110 by moving across the surface S, as indicated by the reference numeral V3 in FIG. 2.

Each wiper member 210 moves to a second contact position V2, and the control unit 130 controls the print head unit 110 so that the nozzle inside each head chip C can spit ink to prevent nozzle blockage. This spitted scrapped ink passes through the spittoon 610 in FIG. 4 of the support member 220 to enter the ink accommodating unit 620 in FIG. 4, and to be finally stored in the scrapped ink storing unit 630 in FIG. 6, thereby completing the spitting operation.

Figure 8D:
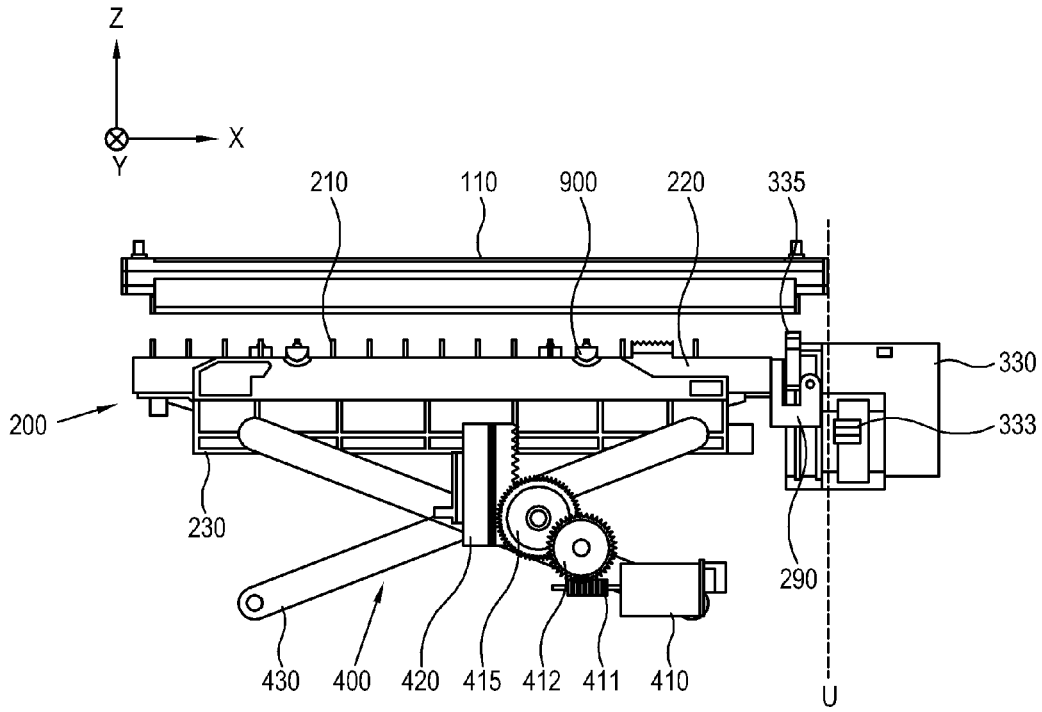

Then, as shown in FIG. 8D, if the support member 220 moves in the opposite direction, the guide protrusion 251 moves downwardly from the third position H3 to the fourth position H4. Accordingly, the support member 220 also downwardly moves with respect to the wiper frame 210 by a height difference between the third position H3 and the fourth position H4.

Figure 8E:
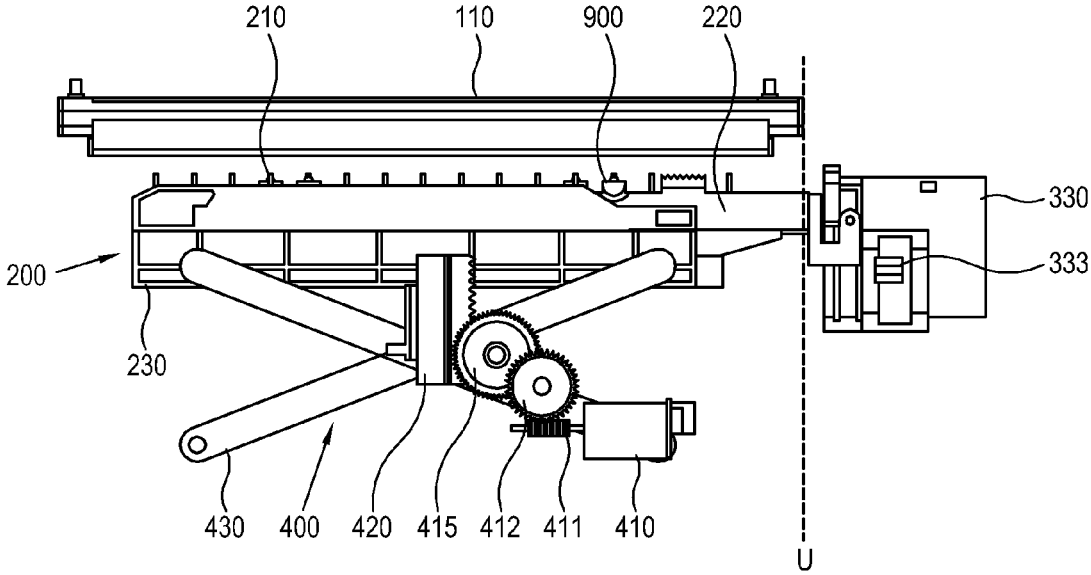

The control unit 130 controls the widthwise direction driving unit 300 so that the support member 220 can move again in the widthwise direction X of the printing medium. Accordingly, as shown in FIG. 8E, the support member 220 moves in the widthwise direction X of the printing medium to be positioned at the original position.

Then, the control unit 130 controls the elevating driving unit 400 so that the wiping unit 200 can downwardly move to the initial retracted position J3 illustrated in FIG. 8A.

Hereinafter, a process of the scrapping operation will be described in detail by referring to FIGS. 1 and 11A-11D. In the present specification and claims, the term "to scrap" or "scrapping" refers to a process to remove excess ink or foreign materials from a nozzle or head chip C of a print head unit 110.

In the scrapping operation, the control unit 130 controls the scrapping driving unit 550 to move the scrapping unit 500 from the second standby position L1 to the cleaning position L2. FIG. 11A illustrates the scrapping unit 500 moved to the cleaning position L2. Since the capping unit 800 is located on an upper surface of the scrapping unit 500, when the scrapping unit 500 moves to the cleaning position L2, the capping unit 800 also moves to the capping position N capping the ink ejecting surface of the print head unit 110.

Figure 11B:
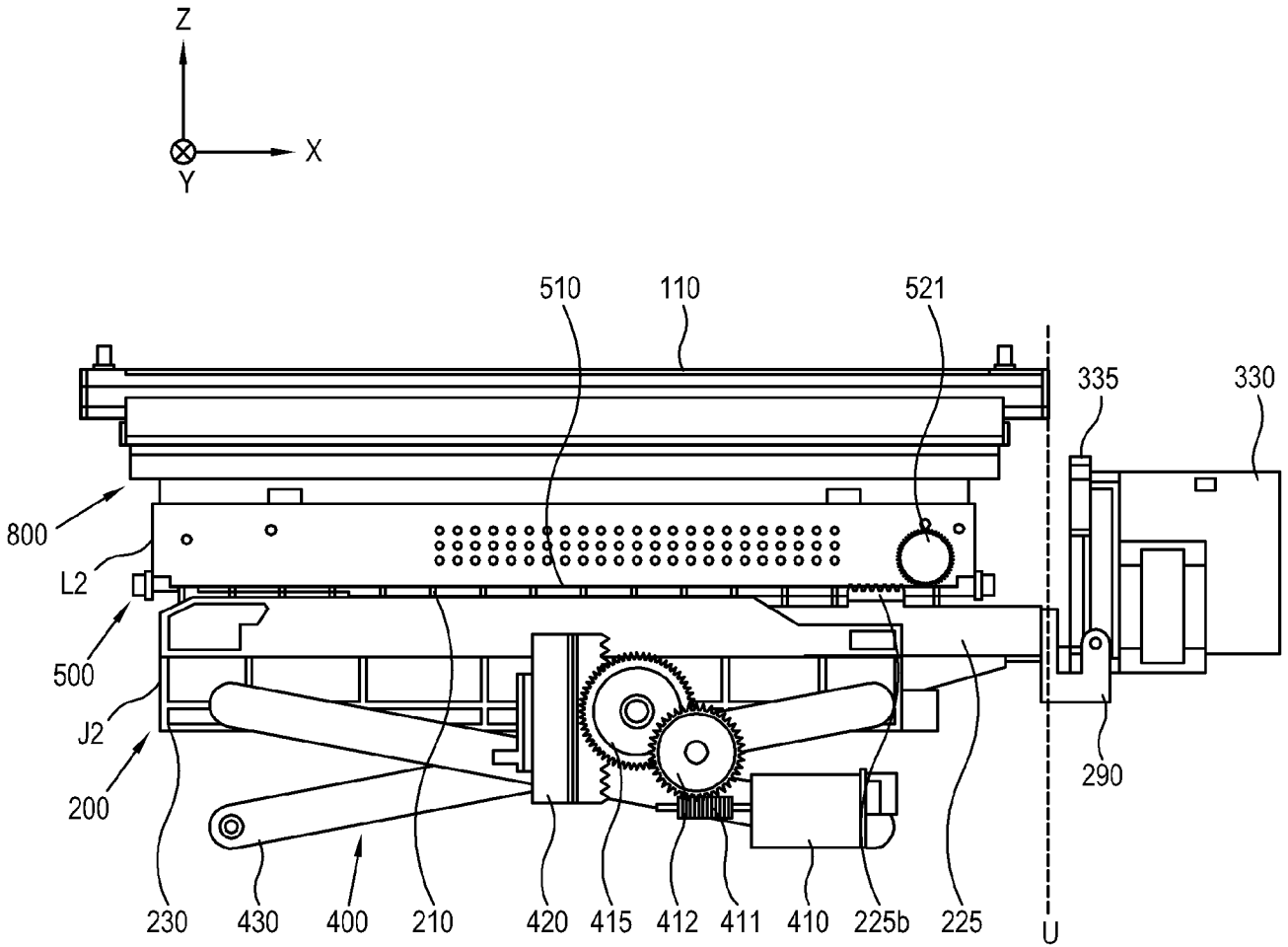

Then, as shown in FIG. 11B, the control unit 130 controls the elevating driving unit 400 so that the wiping unit 200 moves in the upward direction Z from the first retracted position J3. The wiping unit 200 upwardly moves up to the second forward position J2 which is an endless belt contact position. If the wiping unit 200 upwardly moves to the second forward position J2, the second engagement unit 290 is engaged and coupled to the first engagement unit 335 of the shuttle 330 to move back and forth in a predetermined interval in the widthwise direction X of the printing medium together with the shuttle 330.

Figure 11C:
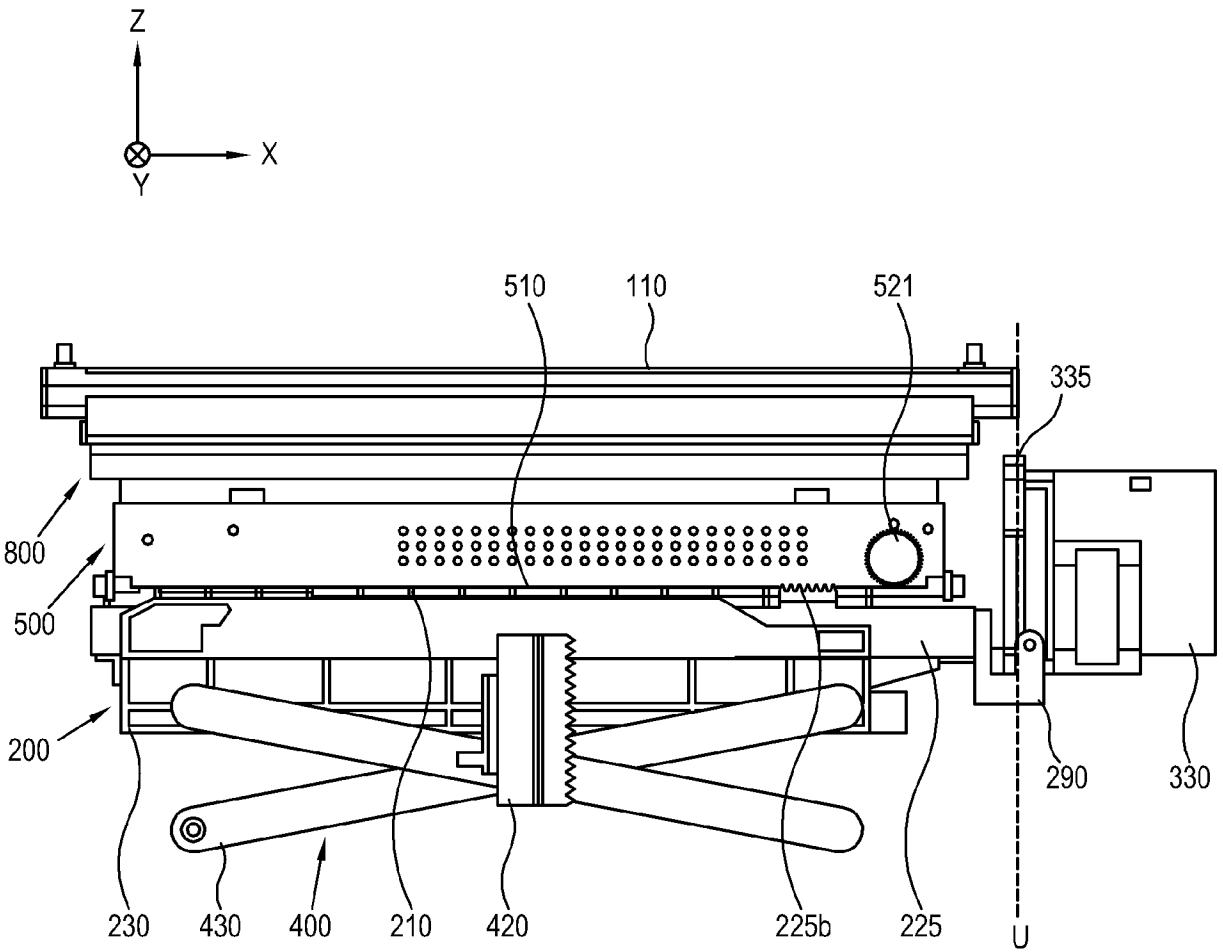

Then, as illustrated in FIG. 11C, the control unit 130 controls the widthwise direction driving unit 300 to move the support member 220 in the widthwise direction X of the printing medium with respect to the wiper frame 230 as the plurality of wiper members 210 contacts the endless belt 510. Accordingly, scrapped ink or foreign materials located on an end part of the wiper member 210 can be cleaned.

Figure 11D:
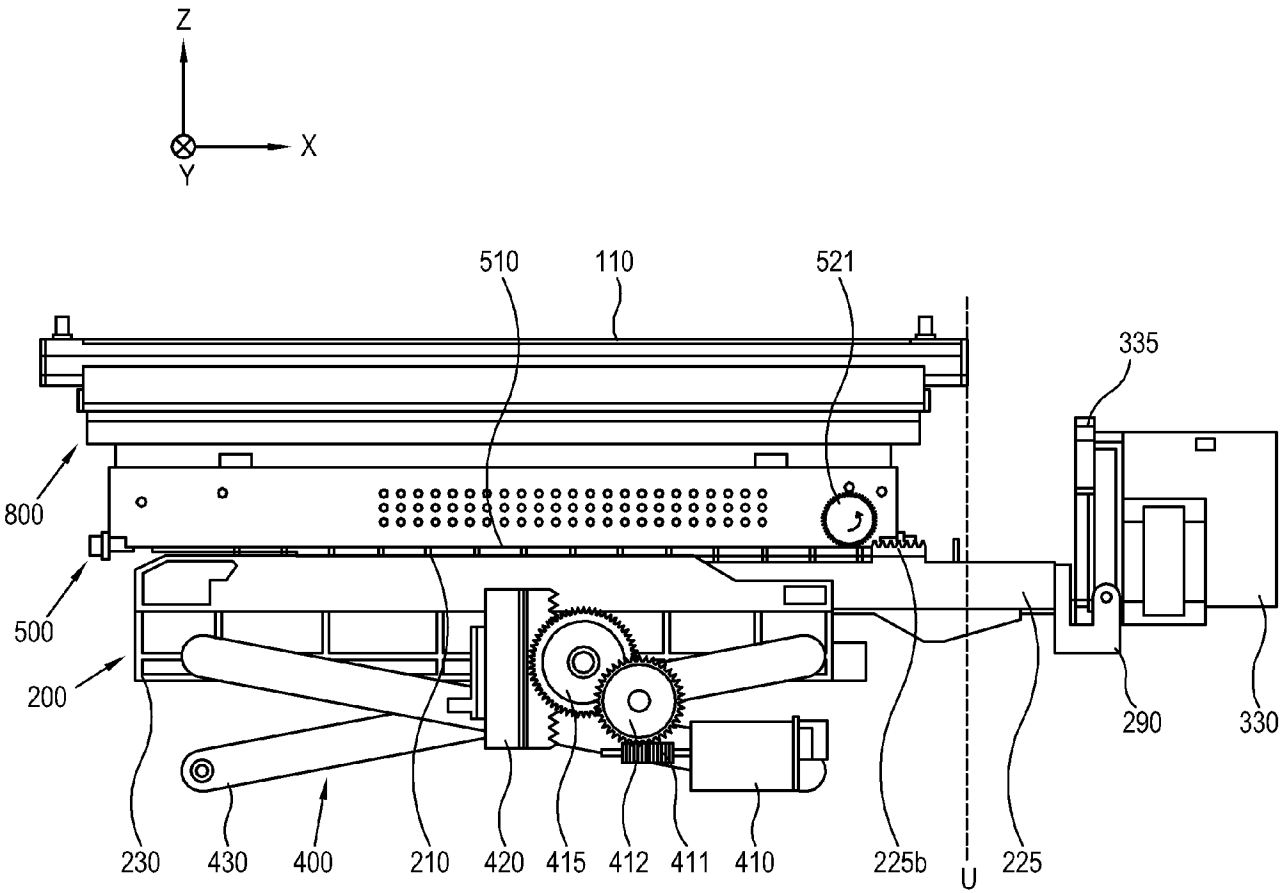

Then, as illustrated in FIG. 11D, the control unit 130 controls the widthwise direction driving unit 300 to move the support member 220 in the widthwise direction X of the printing medium again. Accordingly, a polluted portion of the endless belt 510 polluted by a scrapped ink or a foreign material of the wiper member 210 moves in the widthwise direction X of the printing medium, and a clean portion of the endless belt 510 previously stored in the storing space 526 of the scrapping unit 500 is exposed to be used in the next scrapping operation.

The above wiping, spitting and scrapping operations, as a series of processes, may be controlled by the control unit 130 to be performed in the above order or in any other desired order. If there is a printing demand of a user while performing the maintenance, the control unit 130 may inform the user of the performed maintenance and may inform the user that an immediate printing is impossible. The information may be displayed in an operation panel (not shown), or may be output in a voice through a speaker.

As described above, an image forming apparatus according to the present general inventive concept employs a separate wiper member with respect to each head chip, thereby reducing a wiping time. Also, since each wiper member is capable of being replaced independently, a wiping performance can be improved. Also, in proving an ink discharging unit, a plurality of spittoons and a plurality of ink accommodating units corresponding thereto are provided, and a scrapped ink are concurrently collected, thereby reducing time necessary to collect a scrapped ink to a scrapped ink storing unit.

Also, the present general inventive concept performs wiping, scrapping, capping, and platen operations by using a single space provided to a lower part of a print head unit, thereby improving a space using efficiency to compact the total configuration thereof.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a print head unit including a plurality of head chips arranged in a row in a widthwise direction of a supplied printing medium to eject ink to form an image on the supplied printing medium;

a wiping unit including a plurality of wiper members arranged in a row in the widthwise direction of the printing medium and a support member to support the plurality of wiper members, the wiping unit positioned below the print head unit and movable upwardly toward the print head unit and downwardly away from the print head unit;

an ink discharging unit to accommodate and discharge ink spitted from the print head unit, the ink discharging unit comprising a spittoon in the support member to guide ink spitted from the print head unit to an ink accommodating unit;

an elevating driving unit to move the wiping unit upwardly and downwardly between at least two positions of a first forward position which is a wiping standby position, a second forward position which is a scrapping position, and a retracted position;

the widthwise direction of the printing medium driving unit to move the wiping unit back and forth in a widthwise direction when the wiping unit is positioned in the first or second forward positions;

a scrapping unit which is disposed to a lower part of the print head unit to move between a second standby position and a cleaning position, and cleans the plurality of wiper members;

a scrapping driving unit which drives the scrapping unit so that the scrapping unit configured to move between the cleaning position and the second standby position; and a capping unit which is located below the print head unit to move between a third standby position and a capping position capping the head chip surface of the print head unit.

2. The image forming apparatus according to claim 1, wherein the wiping unit further comprises:

a wiper frame to support the support member, and a guide unit to guide an elevating of each wiper member when the support member is moved in the widthwise direction of the printing medium by the widthwise direction driving unit.

3. The image forming apparatus according to claim 1, wherein the ink accommodating unit is located below the spittoon to accommodate ink discharged from the spittoon; and wherein the scrapped ink a scrapped ink storing unit to accommodate ink discharged through an ink discharging hole of the ink accommodating unit; and a discharging driving source located along an ink discharging path between the ink accommodating unit and the scrapped ink storing unit to move ink from the ink accommodating unit to the scrapped ink storing unit.

4. The image forming apparatus according to claim 1, wherein the widthwise direction driving unit comprises:

a shuttle including a first engagement unit to move in the widthwise direction of the printing medium, and a shuttle driving source to drive the shuttle, and the wiping unit further comprises:

a second engagement unit located on the support member and engaged with the first engagement unit when the wiping unit is positioned in the first and second forward positions.

5. The image forming apparatus according to claim 1, further comprising:

a stopper positioned on at least one of the wiping unit and the print head unit to maintain a contacting force between the head chip and the wiper when the plurality of wiper members contact the ink ejecting surface to perform a wiping operation.

6. The image forming apparatus according to claim 1, further comprising:

a platen located below the print head unit to move between a first standby position and a printing medium support position to support a printing medium so that the printing medium receives thereon ink ejected from the plurality of head chips of the print head unit in a printing operation, and a platen driving unit to drive the platen so that the platen configured to move between the first standby position and the printing medium support position.

7. The image forming apparatus according to claim 2, wherein the guide unit guides the support member so that the plurality of wiper members move upwardly to a position to contact an ink ejecting surface of the print head unit from the first forward position when the support member is moved in a first direction by the widthwise direction driving unit, and the guide unit guides the supporting member so that the plurality of wiper members maintain the first forward position when the support member moves in a second direction opposite the first direction.

8. The image forming apparatus according to claim 3, wherein the ink accommodating unit comprises:

a plurality of accommodating spaces each corresponding to at least one head chip of the plurality of head chips, and the scrapped ink discharging hole is formed in each of the plurality of accommodating spaces so that scrapped ink respectively accommodated in the plurality of accommodating spaces is concurrently discharged to the scrapped ink storing unit.

9. The image forming apparatus according to claim 7, wherein the guide unit comprises:

a guide protrusion located on one of the wiper frame and the support member, and a guide groove located on the other of the wiper frame and the support member to guide an elevating of the guide protrusion.

* * * * *